US009892688B2

(12) United States Patent
In et al.

(10) Patent No.: US 9,892,688 B2
(45) Date of Patent: Feb. 13, 2018

(54) ORGANIC LIGHT-EMITTING DISPLAY

(71) Applicant: SAMSUNG DISPLAY CO., LTD., Yongin, Gyeonggi-Do (KR)

(72) Inventors: Hai Jung In, Seoul (KR); Dong Gyu Kim, Yongin-si (KR); Jung Bae Kim, Yongin-si (KR); Bo Yong Chung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 115 days.

(21) Appl. No.: 14/726,332

(22) Filed: May 29, 2015

(65) Prior Publication Data

US 2016/0203764 A1 Jul. 14, 2016

(30) Foreign Application Priority Data

Jan. 8, 2015 (KR) ..... 10-2015-0002789

(51) Int. Cl.
*G09G 3/3291* (2016.01)
*G09G 3/3225* (2016.01)
(Continued)

(52) U.S. Cl.
CPC ..... *G09G 3/3291* (2013.01); *G09G 3/3225* (2013.01); *G09G 3/3233* (2013.01);
(Continued)

(58) Field of Classification Search
CPC .. G09G 3/3291; G09G 3/3233; G09G 3/3225; G09G 3/3266; G09G 2320/043;
(Continued)

(56) References Cited

U.S. PATENT DOCUMENTS

2009/0051628 A1* 2/2009 Kwon ..... G09G 3/3233 345/77
2009/0309818 A1* 12/2009 Kim ..... G09G 3/3233 345/77
(Continued)

FOREIGN PATENT DOCUMENTS

KR 10-2007-0040004 A 4/2007
KR 10-2009-0020190 A 2/2009
(Continued)

OTHER PUBLICATIONS

KIPO English machine translation of Korean Publication No. KR 10-2010-0089112 A, dated Aug. 11, 2010, 18 pages.

*Primary Examiner* — Aneeta Yodichkas
(74) *Attorney, Agent, or Firm* — Lewis Roca Rothgerber Christie LLP

(57) ABSTRACT

A display includes: a display panel, scan and data drivers, an ADC, a controller, and a data switch. In a first initialization period, the data switch connects data lines to the data driver, which applies an initialization voltage thereto. In a first sensing period, the data switch connects the data lines to the ADC. The ADC receives analog sensing signals corresponding to first voltages of the data lines, and converts the analog sensing signals into digital sensing signals output to the controller. In a second initialization period, the data switch connects the data lines to the data driver, which applies the initialization voltage thereto. In a second sensing period, voltages at the data lines change to second voltages, the data switch connects the ADC to the data lines, and the ADC converts analog sensing signals corresponding to the second voltages into digital sensing signals output to the controller.

19 Claims, 9 Drawing Sheets

(51) Int. Cl.
*G09G 3/3266* (2016.01)
*G09G 3/3233* (2016.01)

(52) U.S. Cl.
CPC ... *G09G 3/3266* (2013.01); *G09G 2300/0814* (2013.01); *G09G 2300/0819* (2013.01); *G09G 2300/0842* (2013.01); *G09G 2300/0861* (2013.01); *G09G 2310/027* (2013.01); *G09G 2310/0248* (2013.01); *G09G 2310/0251* (2013.01); *G09G 2310/0297* (2013.01); *G09G 2320/0233* (2013.01); *G09G 2320/0295* (2013.01); *G09G 2320/043* (2013.01); *G09G 2320/045* (2013.01)

(58) Field of Classification Search
CPC ... G09G 2300/0842; G09G 2300/0861; G09G 2310/0251; G09G 2310/0297; G09G 2320/0295; G09G 2300/0814; G09G 2320/0233; G09G 2310/027; G09G 2310/0248; G09G 2320/045; G09G 2300/0819
See application file for complete search history.

(56) References Cited

U.S. PATENT DOCUMENTS

| | | | | |
|---|---|---|---|---|
| 2011/0018858 | A1* | 1/2011 | Ryu | G09G 3/3233 345/213 |
| 2011/0084955 | A1* | 4/2011 | Kim | G09G 3/3283 345/212 |

FOREIGN PATENT DOCUMENTS

| | | | |
|---|---|---|---|
| KR | 10-2010-0089112 | A | 8/2010 |
| KR | 10-2011-0039773 | A | 4/2011 |
| KR | 10-2012-0135388 | A | 12/2012 |
| KR | 10-2013-0061596 | A | 6/2013 |

* cited by examiner

ORGANIC LIGHT-EMITTING DISPLAY

CROSS-REFERENCE TO RELATED APPLICATION

This application claims priority to and the benefit of Korean Patent Application No. 10-2015-0002789 filed on Jan. 8, 2015 in the Korean Intellectual Property Office, the disclosure of which is incorporated herein by reference in its entirety.

BACKGROUND

1. Field

The present invention relates to an organic light-emitting display, and more particularly, to an organic light-emitting display with improved display quality.

2. Description of the Related Art

As monitors, televisions, portable displays, etc. are becoming lighter and thinner, conventional cathode ray tubes (CRTs) are being replaced by flat panel displays such as liquid crystal displays (LCDs) and organic electroluminescent displays. Of these flat panel displays, organic light-emitting displays are drawing attention as next-generation flat panel displays due to their high response speed, low power consumption, and wide viewing angles.

An organic light-emitting display is known to adjust the brightness or gray level of one pixel by adjusting the magnitude of a current provided to an organic light-emitting diode. Here, the magnitude of the current provided to the organic light-emitting diode may be determined by a voltage difference between a gate and a source of a driving transistor and a coefficient of current driving characteristics of the driving transistor. In an ideal case, driving transistors of all pixels of the organic light-emitting display have the same characteristics, and the pixels express the same gray level for the same data voltage. In reality, however, the driving transistors of the pixels may have different characteristic coefficients due to, for example, differences in processing conditions and differences in the degree of degradation. The different characteristic coefficients can cause an imbalance in gray level between locations on the organic light-emitting display.

SUMMARY

Aspects of embodiments according to the present invention provide an organic light-emitting display with improved display quality.

However, aspects of the present invention are not limited to the one set forth herein. The above and other aspects of embodiments of the present invention will become more apparent to one of ordinary skill in the art to which the present invention pertains by referencing the detailed description of example embodiments of the present invention given below.

According to example embodiments of the present invention, an organic light-emitting display is provided. The organic light-emitting display includes: a display panel including a plurality of pixels respectively connected to a plurality of scan lines and a plurality of data lines; a scan driver configured to sequentially transmit a plurality of scan signals to the scan lines; a data driver configured to receive an image signal and to output a plurality of data output signals; a voltage analog-to-digital converter (ADC) configured to receive analog sensing signals and to output digital sensing signals; a data switch configured to connect the data lines to the data driver or to the voltage ADC in response to a switching signal; and a controller configured to receive original image data and the digital sensing signals, to process the original image data into the image signal based on the digital sensing signals and provide the image signal to the data driver, and to provide the switching signal to the data switch, wherein the data switch is configured to connect the data lines to the data driver, and the data driver is configured to apply an initialization voltage to the connected data lines, in a first initialization period, wherein one or more of the pixels are configured to charge one or more of the data lines with first voltages, the data switch is configured to connect the voltage ADC to the data lines, and the voltage ADC is configured to receive the first voltages from the connected data lines, to convert analog sensing signals corresponding to the first voltages into digital sensing signals, and to output the digital sensing signals to the controller, in a first sensing period, wherein the data switch is configured to connect the data lines to the data driver, and the data driver is configured to apply the initialization voltage to the connected data lines, in a second initialization period, and wherein the display is configured to change voltages applied to the data lines from the initialization voltage to second voltages, the data switch is configured to connect the voltage ADC to the data lines, and the voltage ADC is configured to receive the second voltages from the connected data lines, to convert analog sensing signals corresponding to the second voltages into digital sensing signals and to output the digital sensing signals to the controller, in a second sensing period.

The first initialization period, the first sensing period, the second initialization period, and the second sensing period may be included in a period of time during which an image of one frame is displayed.

The first sensing period and the second sensing period may have substantially the same lengths.

The controller may be configured to identify voltages obtained by subtracting the second voltages from the first voltages based on the digital sensing signals corresponding to the first voltages and the digital sensing signals corresponding to the second voltages.

At least one of the pixels may include first, second, third, fourth, and fifth transistors that are p-channel metal oxide semiconductor (PMOS) transistors, a node connected to a source terminal of the first transistor may be connected to a drain terminal of the fourth transistor, the source terminal of the first transistor may be connected to a first power source by the fourth transistor, a node connected to a drain terminal of the first transistor may be connected to an anode of an organic light-emitting diode, a cathode of the organic light-emitting diode may be connected to a second power source, a drain terminal of a second transistor may be connected to a node connected to a gate terminal of the first transistor, a source terminal of the second transistor may be connected to at least one of the data lines, a gate terminal of the second transistor may be connected to at least one of the scan lines, a source terminal of the third transistor may be connected to the node connected to the drain terminal of the first transistor, a drain terminal of the third transistor may be connected to at least one of the data lines, a sensing voltage may be connected to a gate terminal of the third transistor, the drain terminal of the fourth transistor may be connected to the node connected to the source terminal of the first transistor, a source terminal of the fourth transistor may be connected to the first power source, a gate terminal of the fourth transistor may be connected to an emission voltage, a source terminal of the fifth transistor may be connected to a sustain voltage, a drain terminal of the fifth transistor may be connected to the node connected to the source terminal of the first transistor, and a gate terminal of the fifth transistor may be connected to at least one of the scan lines.

At least one of the pixels may further include a sixth transistor, wherein a source terminal of the sixth transistor may be connected to the node connected to the source terminal of the first transistor, a drain terminal of the sixth transistor may be connected to the node connected to the gate terminal of the first transistor, and a gate terminal of the sixth transistor may be connected to a bias voltage.

At least one of the pixels may further include a storage capacitor connected between the node connected to the source terminal of the first transistor and the node connected to the gate terminal of the first transistor.

The data switch may be configured to connect the data lines to the data driver, and the data driver may be configured to apply the initialization voltage to the connected data lines, in a third initialization period, wherein one or more of the pixels may be configured to charge one or more of the data lines with third voltages, the data switch may be configured to connect the voltage ADC to the data lines, and the voltage ADC may be configured to receive the third voltages from the connected data lines, to convert analog sensing signals corresponding to the third voltages into digital sensing signals and to output the digital sensing signals to the controller, in a third sensing period, wherein the data switch may be configured to connect the data lines to the data driver, and the data driver may be configured to apply the initialization voltage to the connected data lines, in a fourth initialization period, and wherein the display may be configured to change the voltages applied to the data lines from the initialization voltage to fourth voltages, the data switch may be configured to connect the voltage ADC to the data lines, and the voltage ADC may be configured to receive the fourth voltages from the connected data lines, to convert analog sensing signals corresponding to the fourth voltages into digital sensing signals and to output the digital sensing signals to the controller, in a fourth sensing period.

The first initialization period, the first sensing period, the second initialization period, the second sensing period, the third initialization period, the third sensing period, the fourth initialization period, and the fourth sensing period may be included in a period of time during which an image of one frame is displayed.

The first sensing period and the second sensing period may have substantially the same lengths, and the third sensing period and the fourth sensing period may have substantially the same lengths.

The controller may be configured to identify voltages obtained by subtracting the second voltages from the first voltages based on the digital sensing signals corresponding to the first voltages and the digital sensing signals corresponding to the second voltages, to identify voltages obtained by subtracting the fourth voltages from the third voltages based on the digital sensing signals corresponding to the third voltages and the digital sensing signals corresponding to the fourth voltages, and to correct the image signal for each of the pixels based on the voltages obtained by subtracting the second voltages from the first voltages and the voltages obtained by subtracting the fourth voltages from the third voltages.

An organic light-emitting display including: a display panel comprising a plurality of pixels respectively connected to a plurality of scan lines and a plurality of data lines; a scan driver configured to sequentially transmit a plurality of scan signals to the scan lines; a data driver configured to receive an image signal and to output a plurality of data output signals; a voltage ADC configured to receive analog sensing signals and to output digital sensing signals; a data switch configured to connect the data lines to the data driver or to the voltage ADC in response to a switching signal; and a controller configured to receive original image data and the digital sensing signals, to process the original image data into the image signal based on the digital sensing signals and provide the image signal to the data driver, and to provide the switching signal to the data switch, wherein at least one of the pixels comprises first, second, third, fourth, and fifth transistors, and wherein a node connected to a source terminal of the first transistor is connected to a drain terminal of the fourth transistor, the source terminal of the first transistor is connected to a first power source by the fourth transistor, a node connected to a drain terminal of the first transistor is connected to an anode of an organic light-emitting diode, a cathode of the organic light-emitting diode is connected to a second power source, a drain terminal of a second transistor is connected to a node connected to a gate terminal of the first transistor, a source terminal of the second transistor is connected to at least one of the data lines, a gate terminal of the second transistor is connected to at least one of the scan lines, a source terminal of the third transistor is connected to the node connected to the drain terminal of the first transistor, a drain terminal of the third transistor is connected to at least one of the data lines, a sensing voltage is connected to a gate terminal of the third transistor, the drain terminal of the fourth transistor is connected to the node connected to the source terminal of the first transistor, a source terminal of the fourth transistor is connected to the first power source, a gate terminal of the fourth transistor is connected to an emission voltage, a source terminal of the fifth transistor is connected to a sustain voltage, a drain terminal of the fifth transistor is connected to the node connected to the source terminal of the first transistor, and a gate terminal of the fifth transistor is connected to at least one of the scan lines.

At least one of the pixels may further include a sixth transistor, wherein a source terminal of the sixth transistor may be connected to the node connected to the source terminal of the first transistor, a drain terminal of the sixth transistor may be connected to the node connected to the gate terminal of the first transistor, and a gate terminal of the sixth transistor may be connected to a bias voltage.

At least one of the pixels may further include a storage capacitor connected between the node connected to the source terminal of the first transistor and the node connected to the gate terminal of the first transistor.

The data switch may be configured to connect the data lines to the data driver, and the data driver may be configured to apply an initialization voltage to the connected data lines, in a first initialization period, wherein one or more of the pixels may be configured to charge one or more of the data lines with first voltages, the data switch may be configured to connect the voltage ADC to the data lines, and the voltage ADC may be configured to receive the first voltages from the connected data lines, to convert analog sensing signals corresponding to the first voltages into digital sensing signals and to output the digital sensing signals to the controller, in a first sensing period, wherein the data switch may be configured to connect the data lines to the data driver, and the data driver may be configured to apply the initialization voltage to the connected data lines, in a second initialization period, and wherein the display may be configured to change voltages applied to the data lines from the initialization voltage to second voltages, the data switch may be configured to connect the voltage ADC to the data lines, and the voltage ADC may be configured to receive the second voltages from the connected data lines, to convert analog sensing signals corresponding to the second voltages into digital sensing signals and to output the digital sensing signals to the controller, in a second sensing period.

The data switch may be configured to connect the data lines to the data driver, and the data driver may be configured to apply the initialization voltage to the connected data lines, in a third initialization period, wherein one or more of the pixels may be configured to charge one or more of the data lines with third voltages, the data switch may be configured to connect the voltage ADC to the data lines, and the voltage ADC may be configured to receive the third voltages from the connected data lines, to convert the analog sensing signals corresponding to the third voltages into digital sensing signals and to output the digital sensing signals to the controller, in a third sensing period, wherein the data switch may be configured to connect the data lines to the data driver, and the data driver may be configured to apply the initialization voltage to the connected data lines, in a fourth initialization period, and wherein the display may be configured to change voltages applied to the data lines from the initialization voltage to fourth voltages, the data switch may be configured to connect the voltage ADC to the data lines, and the voltage ADC may be configured to receive the fourth voltages from the connected data lines, to convert analog sensing signals corresponding to the fourth voltages into digital sensing signals and to output the digital sensing signals to the controller.

The first initialization period, the first sensing period, the second initialization period, the second sensing period, the third initialization period, the third sensing period, the fourth initialization period, and the fourth sensing period may be included in a period of time during which an image of one frame is displayed.

The first sensing period and the second sensing period may have substantially the same lengths, and the third sensing period and the fourth sensing period may have substantially the same lengths.

The controller may be configured to identify voltages obtained by subtracting the second voltages from the first voltages based on the digital sensing signals corresponding to the first voltages and the digital sensing signals corresponding to the second voltages, to identify voltages obtained by subtracting the fourth voltages from the third voltages based on the digital sensing signals corresponding to the third voltages and the digital sensing signals corresponding to the fourth voltages, and to correct the image signal for each of the pixels based on the voltages obtained by subtracting the second voltages from the first voltages and the voltages obtained by subtracting the fourth voltages from the third voltages.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
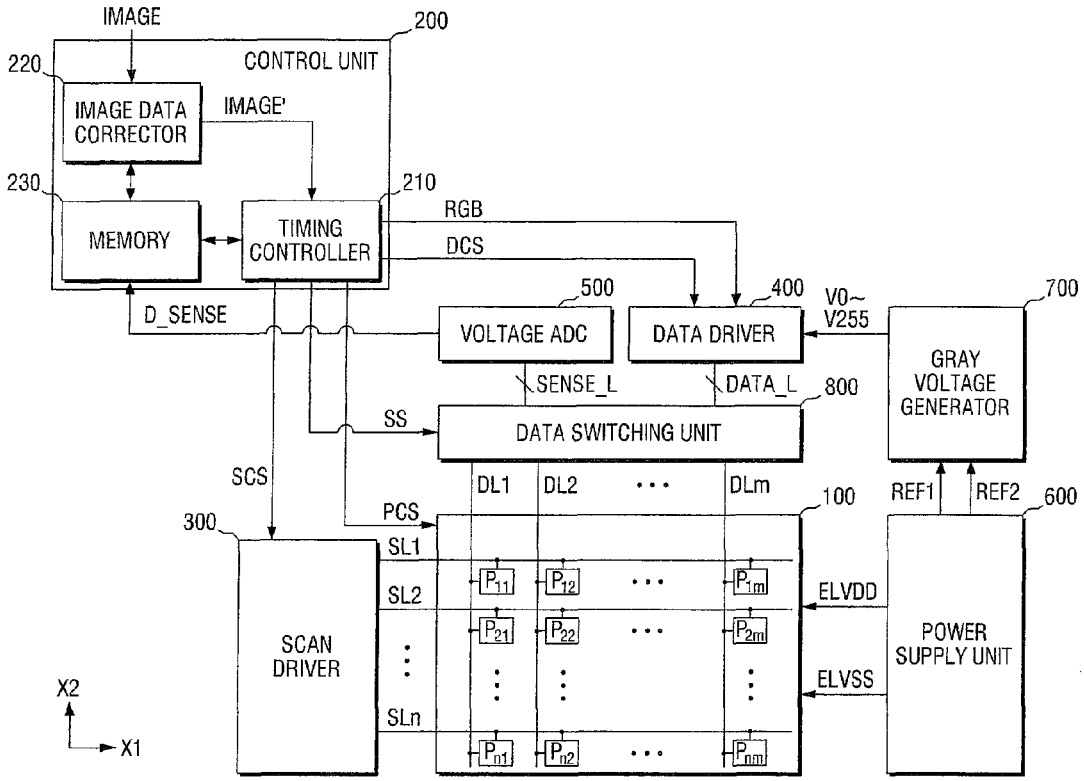
FIG. 1 is a schematic block diagram of an organic light-emitting display according to an embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, embodiments of the present invention will be described in detail with reference to the attached drawings.

FIG. 1 is a schematic block diagram of an organic light-emitting display according to an embodiment of the present invention.

Referring to FIG. 1, the organic light-emitting display may include a display panel 100, a control unit (or controller) 200, a scan driver 300, a data driver 400, a voltage analog-to-digital converter (ADC) 500, a power supply unit (or power supply) 600, a gray voltage generator 700, and a data switching unit (or a data switch) 800.

In FIG. 1, each element is illustrated as a different block. However, the elements illustrated in FIG. 1 are just separated based on their functions. Each of the elements may be a complex of algorithms physically implemented in one element, for example, one IC chip.

For example, the control unit (or controller) 200, a timing controller, an image data corrector, a memory, the scan driver 300, the data driver 400, the voltage analog-to-digital converter (ADC) 500, the power supply unit (or power supply) 600, the gray voltage generator 700, and the data switching unit (or data switch) 800 and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or the like. Further, the various components of these devices may be a process or thread, running on one or more processors, in one or more computing devices, executing computer program instructions and interacting with other system components for performing the various functionalities described herein. The computer program instructions may be stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the sprit and scope of the exemplary embodiments of the present invention.

The display panel 100 may include a plurality of scan lines SL1 through SLn extending in a first direction X1, a plurality of data lines DL1 through DLm extending in a second direction X2, and a plurality of pixels connected to the scan lines SL1 through SLn and the data lines DL1 through DLm. The configuration and operation of each of the pixels will be described in detail later with reference to FIGS. 5 and 6.

The control unit (or controller) 200 may receive original image data IMAGE and digital sensing signals from external sources, process the original image data IMAGE into an image signal RGB based on the digital sensing signals, and provide the image signal RGB to the data driver 400. In particular, in an embodiment of the present invention, the control unit 200 may provide a switching signal SS to the data switching unit (or data switch) 800, and the data switching unit 800 may connect the data lines DL1 through DLm to the data driver 400 or the voltage ADC 500 in response to the switching signal SS.

To perform the above function, the control unit 200 according to an embodiment of the present invention may include an image data corrector 220, a timing controller 210, and a memory 230.

The timing controller 210 may receive corrected image data IMAGE' from the image data corrector 220, process the corrected image data IMAGE' into the image signal RGB, and transmit the image signal RGB to the data driver 400. The timing controller 210 may also output a data control signal DCS and a scan control signal SCS for driving the data driver 400 and the scan driver 300, respectively, in synchronization with the image signal RGB. The image signal RGB may be a signal obtained by processing the corrected image data IMAGE' such that the corrected image data IMAGE' corresponds to a gray value or gray voltage of each pixel of the display panel 100. In addition, the timing controller 210 may process the corrected image data IMAGE' into the image signal RGB by additionally modulating or compensating the corrected image data IMAGE' according to a user's preference or unique characteristics of the organic light-emitting display.

Further, the timing controller 210 may provide a pixel control signal PCS for controlling the driving of the pixels of the display panel 100 to the pixels of the display panel 100.

The timing controller 210 may provide the switching signal SS to the data switching unit 800, and the data switching unit 800 may connect the data lines DL1 through DLm to the data drive 400 or the voltage ADC 500 in response to the switching signal SS.

The image data corrector 220 may read correction reference values from the memory 230 and receive the original image data IMAGE from an external image source, e.g., an external graphics processing unit (or an external graphics processor). The image data corrector 220 may generate the corrected image data IMAGE' by correcting the original image data IMAGE based on the correction reference values.

Here, the correction reference values may be offset values indicating differences in respective driving characteristics of the pixels. The offset values may be cumulatively updated values of the digital sensing signals recorded in the memory 230 through the voltage ADC 500.

In addition, the image data corrector 220 may store the received original image data IMAGE or the corrected image data IMAGE' in the memory 230.

The memory 230 may be a nonvolatile memory that can retain unique information about a display device, for example, a lookup table of specifications, characteristics, and gamma curves of the display device even when the display device is powered off. Examples of the nonvolatile memory may include a flash memory and an electrically erasable programmable read-only memory (EEPROM). Alternatively, the memory 230 may be a volatile memory that can retain information about the correction reference values (e.g., the cumulatively updated offset values) when the display device is powered on. Examples of the volatile memory may include a dynamic random access memory (DRAM) or a static random access memory (SRAM). In other embodiments, the memory 230 may include any suitable combination of volatile and non-volatile memories.

In FIG. 1, the timing controller 210 and the image data corrector 220 are illustrated as separate functional blocks. However, the present invention is not limited thereto. As a part of an image processing algorithm of the timing controller 210, the image data corrector 220 may be an algorithm for performing an image correction function according to an embodiment of the present invention. Alternatively, the timing controller 210 and the image data corrector 220 may be a single module embedded in a single IC chip.

The scan driver 300 may receive the scan control signal SCS from the timing controller 210 and sequentially drive the scan lines SL1 through SLn in response to the received scan control signal SCS.

The data driver 400 may receive the image signal RGB and the data control signal DCS from the timing controller 210 and output a plurality of data output signals DO1 through DOm (or D1 through Dm) for driving the data lines DL1 through DLm in response to the image signal RGB and the data control signal DCS. For example, the data output signals DO1 through DOm may be provided to the data lines DL1 through DLm via the data switching unit 800.

By way of example, the data driver 400 may receive a plurality of gray voltages V0 through V255 from the gray voltage generator 700, select one or more of the received gray voltages V0 through V255, and apply the selected gray voltages to the data switching unit 800 as the data output signals DO1 through DOm. In addition, the data driver 400 may change the data output signals DO1 through DOm in response to the data control signal DCS and output a voltage signal (e.g., an initialization signal) other than the received image signal RGB as the data output signals DO1 through DOm.

The data switching unit 800 may connect the data lines DL1 through DLm to the data driver 400 or the voltage ADC 500 in response to the switching signal SS received from the timing controller 210. That is, in order to deliver a plurality of data voltages output from the data driver 400 to the data lines DL1 through DLm, the data switching unit 800 may connect the data lines DL1 through DLm to the data driver 400. In order for the voltage ADC 500 to sense voltages of the data lines DL1 through DLm, the data switching unit 800 may connect the data lines DL1 through DLm to the voltage ADC 500. For example, the data switching unit 800 may be connected to the voltage ADC 500 by a sensing line SENSE_L, connected to the data driver 400 by a data transmission line DATA_L, and connected to the display panel 100 by the data lines DL1 through DLm.

A plurality of data signals, as used herein, refer to levels of voltages applied to the data lines DL1 through DLm and are distinguished from the data output signals DO1 through DOm output from the data driver 400. For example, when the data switching unit 800 connects the data transmission line DATA_L connected to the data driver 400 to the data lines DL1 through DLm, the data output signals DO1 through DOm may be substantially the same as (e.g., identical to) the data signals. However, when the data switching unit 800 connects the sensing line SENSE_L connected to the voltage ADC 500 to the data lines DL1 through DLm, the data output signals DO1 through DOm may be different from the data signals.

The voltage ADC 500 may be connected to the data lines DL1 through DLm by the data switching unit 800. For example, to sense the data signals corresponding to the levels of the voltages applied to the data lines DL1 through DLm, the data switching unit 800 may connect the sensing line SENSE_L connected to the voltage ADC 500 to the data lines DL1 through DLm. Accordingly, the voltage ADC 500 may receive the data signals corresponding to the voltage levels of the data lines DL1 through DLm as analog signals, convert the analog signals into digital sensing signals, and output the digital sensing signals. The output digital sensing signals may be written to the memory 230 of the control unit 200.

In FIG. 1, the data switching unit 800, the voltage ADC 500 and the data driver 400 are illustrated as separate functional blocks. However, the present invention is not limited thereto. The data switching unit 800, the data driver 400 and the voltage ADC 500 may also be integrally formed on the same IC chip and connected accordingly to at least part of the display panel 100. Alternatively, the data switching unit 800, the data driver 400 and the voltage ADC 500 may be integrally formed as a single driver IC, together with the control unit 200 or the scan driver 300. Alternatively, the data switching unit 800, the data driver 400 and the voltage ADC 500 may be formed as integrated circuits on at least an area of the display panel 100.

The power supply unit 600 may be a voltage source which applies an appropriate voltage to each element (or component) in the display panel 100. For example, in an embodiment of the present invention, the power supply unit 600 may provide a first power source ELVDD and a second power source ELVSS to the pixels of the display panel 100 and provide a first reference voltage REF1 and a second reference voltage REF2 to the gray voltage generator 700.

The gray voltage generator 700 may receive at least the first reference voltage REF1 and the second reference voltage REF2 from the power supply unit 600 and generate the gray voltages V0 through V255 by dividing the first reference voltage REF1 and the second reference voltage REF2.

In FIG. 1, the gray voltage generator 700 generates 256 gray voltages V0 through V255. However, the present invention is not limited thereto. A set of gray voltages generated by the gray voltage generator 700 may be increased or decreased according to required display quality and panel size of the display panel 100 and the method of driving the display panel 100 and the data driver 400. Although not illustrated in the drawing, the gray voltage generator 700 may receive a gray voltage selection signal from the timing controller 210 and adjust levels of the gray voltages V0 through V255 according to the received gray voltage selection signal.

A data signal sensing operation and an image data correction operation of the organic light-emitting display of FIG. 1 will now be described in detail with reference to FIGS. 2 and 3.

Figure 2:
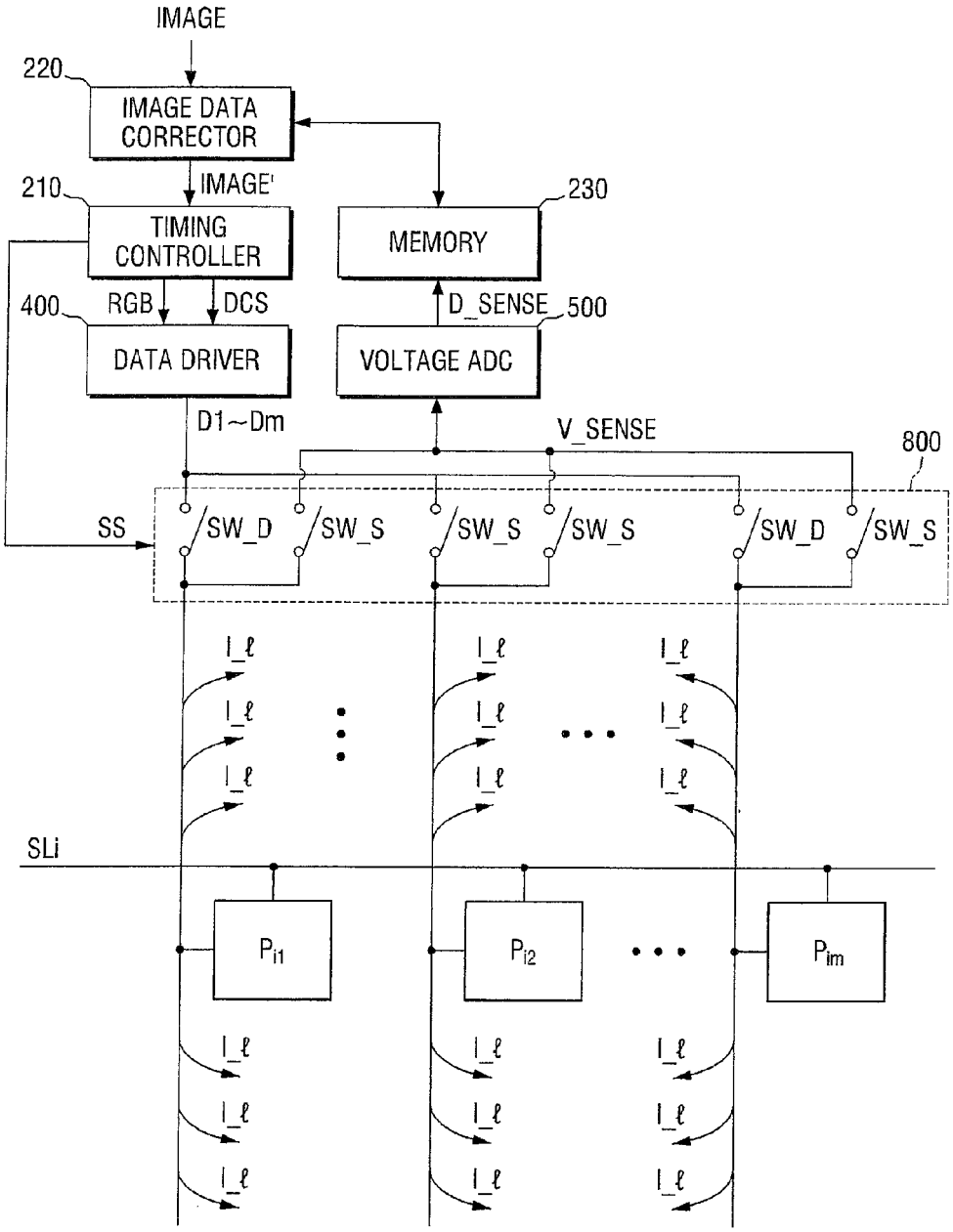
FIG. 2 is a schematic block diagram illustrating part of a display panel of the organic light-emitting display of FIG. 1 and other elements connected to the display panel.

FIG. 2 is a schematic block diagram illustrating part of the display panel 100 of the organic light-emitting display of FIG. 1 and other elements connected to the display panel 100.

Figure 3:
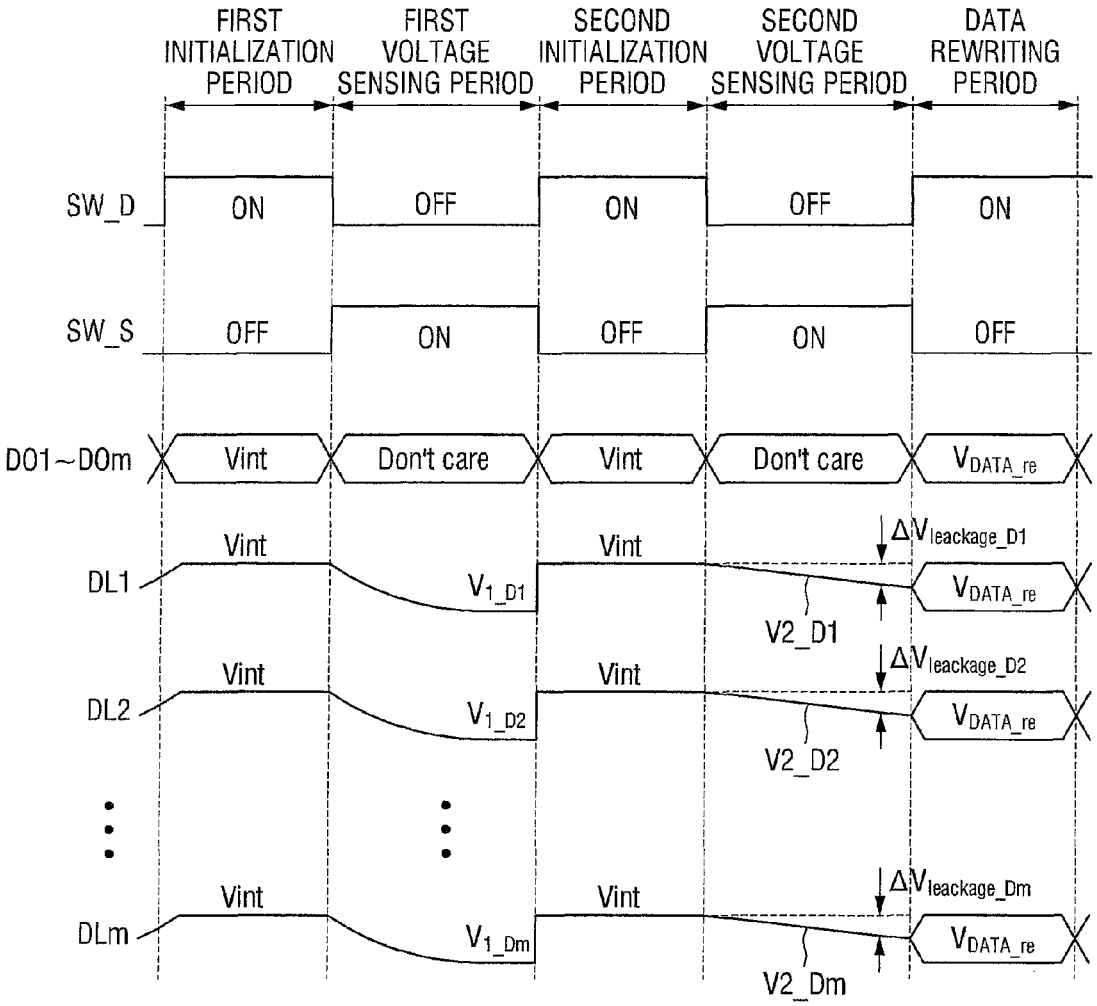
FIG. 3 is a timing diagram illustrating a data voltage sensing operation of the organic light-emitting display of FIG. 1.

FIG. 3 is a timing diagram illustrating a data voltage sensing operation of the organic light-emitting display of FIG. 1.

In FIGS. 2 and 3, one scan line SLi and a plurality of pixels Pi1 through Pim connected to the data lines DL1 through DLm are illustrated as an example.

Referring to FIGS. 2 and 3, in the organic light-emitting display of FIG. 1, a plurality of pixels may respectively be connected to the scan lines SL1 through SLn and the data lines DL1 through DLm, and data signals transmitted from the data lines DL1 through DLm may respectively be provided to the pixels in response to scan signals transmitted from the scan lines SL1 through SLn. Each of the pixels receiving the data signals may provide an organic light-emitting diode with a driving current of a magnitude corresponding to the voltage level of a corresponding data signal, and the organic light-emitting diode may emit light at a brightness level corresponding to the magnitude of the driving current.

The magnitude of the driving current flowing through each of the pixels may be controlled by adjusting the voltage level of the data signal transmitted to a gate of a driving transistor.

In a saturated state, an electric current flowing through the driving transistor can generally be approximated to Equation (1) below:

$$I = \frac{1}{2}\mu C_{ox}\frac{W}{L}(V_{SG} - |V_{th}|)^2, \quad (1)$$

where μ, $C_{ox}$, W, and L respectively are charge mobility, gate capacitance per unit area, channel width and channel length of a driving transistor, that is, unique characteristic coefficients of each transistor, and Vth is a threshold voltage corresponding to a minimum source-gate voltage difference for turning the driving transistor on, that is, another unique characteristic coefficient of each transistor.

Ideally, driving transistors included in a plurality of pixels of an organic light-emitting display have the same characteristic coefficients. In reality, however, the pixels of the organic light-emitting display may have minutely different characteristic coefficients due to, for example, differences in processing conditions and differences in the degree of degradation of each pixel resulting from continued use of the panel. The different characteristic coefficients of the pixels cause the pixels to emit light of different gray levels for the same image data, i.e., the same data signal, thereby degrading the display quality of the organic light-emitting display.

In an embodiment of the present invention, the voltage ADC 500 may sense a value of a driving current corresponding to a driving threshold voltage and a driving reference voltage of a driving transistor from each of the data lines DL1 through DLm and transmit the sensed values to the control unit 200. The image data corrector 220 of the control unit 200 may generate the corrected image data IMAGE' by correcting the original image data IMAGE based on the sensed values related to characteristic coefficients of a plurality of pixels.

For example, the data switching unit 800 may connect the data driver 400 or the voltage ADC 500 to the data lines DL1 through DLm in response to the switching signal SS. When the data driver 400 is connected to the data lines DL1 through DLm, the data output signals DO1 through DOm may be provided to the data lines DL1 through DLm as data signals, and a plurality of pixels may display images corresponding to the data signals.

While an image of one frame is being displayed on the display panel 100 or during a standby period after an image of one frame is displayed and before an image of a next frame is displayed, a data signal sensing operation according to an embodiment of the present invention may be performed.

In a first initialization period, a data switch SW_D may be turned on, and a sensing switch SW_S may be turned off. That is, in the first initialization period, the data switching unit 800 may connect the data driver 400 to the data lines DL1 through DLm and disconnect the data lines DL1 through DLm from the voltage ADC 500.

In the first initialization period, the data driver 400 may output an initialization voltage signal Vint as the data output signals DO1 through DOm in response to the data control signal DCS from the timing controller 210, and data signals corresponding to the initialization voltage signal Vint may be provided to all data lines DL1 through DLm.

In a first voltage sensing period, the data switch SW_D may be turned off, and the sensing switch SW_S may be turned on. That is, in the first voltage sensing period, the data switching unit 800 may disconnect the data lines DL1 through DLm from the data driver 400 and connect the data lines DL1 through DLm to the voltage ADC 500.

In the first voltage sensing period, the pixels Pi1 through Pim connected to the $i^{th}$ scan line SLi may charge the connected data lines DL1 through DLm with first voltages V1_D1 through V1_Dm in response to the pixel control signal PCS. Charging the data lines DL1 through DLm with the first voltages V1_D1 through V1_Dm may be continued during the first voltage sensing period. The voltage ADC 500 may receive voltage levels (i.e., data signals) of the data lines DL1 through DLm as analog sensing signals, convert the analog sensing signals into digital sensing signals, and transmit the digital sensing signals to the memory 230 of the control unit 200.

The first voltages V1_D1 through V1_Dm charged in the data lines DL1 through DLm during the first voltage sensing period may be values related to characteristic coefficients about driving currents flowing through the pixels Pi1 through Pim connected to the data lines DL1 through DLm. The control unit 200 can update correction reference values used to compensate for respective characteristic coefficient differences of the pixels Pi1 through Pim by sensing the first voltages V1_D1 through V1_Dm.

As illustrated in FIG. 2, while performing the first voltage sensing operation for the pixels Pi1 through Pim connected to the $i^{th}$ scan line SLi, leakage currents I_I may be generated through transistors of other pixels not performing the sensing operation. The leakage currents I_I can affect the first voltages V1_D1 through V1_Dm charged in the data lines DL1 through DLm.

Switching transistors that switchably connect the other pixels not performing the sensing operation to the data lines DL1 through DLm may remain turned off. In the case of unideal switching transistors, however, fine (or very small) currents may flow even when the switching transistors are turned off. Since scan lines not performing the sensing operation and pixels connected to the scan lines far outnumber the $i^{th}$ scan line SLi and the pixels Pi1 through Pim connected to the $i^{th}$ scan line SLi, the leakage currents I_I can greatly affect data signals sensed.

In particular, the smaller the first voltages V1_D1 through V1_Dm sensed, the greater the effect of the leakage currents I_I.

In a second initialization period, the data switch SW_D may be turned on, and the sensing switch SW_S may be turned off. That is, in the second initialization period, the data switching unit 800 may connect the data driver 400 to the data lines DL1 through DLm and disconnect the data lines DL1 through DLm from the voltage ADC 500.

In the second initialization period, the data driver 400 may output the initialization voltage signal Vint as the data output signals DO1 through DOm in response to the data control signal DCS from the timing controller 210, and data signals corresponding to the initialization voltage signal Vint may be provided to all data lines DL1 through DLm.

In a second voltage sensing period, the data switch SW_D may be turned off, and the sensing switch SW_S may be turned on. That is, in the second voltage sensing period, the data switching unit 800 may disconnect the data lines DL1 through DLm from the data driver 400 and connect the data lines DL1 through DLm to the voltage ADC 500.

In the second voltage sensing period, the switching transistors of the pixels Pi1 through Pim connected to the $i^{th}$ scan line SLi may remain turned off and may be disconnected from the data lines DL1 through DLm.

In the second voltage sensing period, the leakage currents I_I may be generated between the data lines DL1 through DLm and other pixels connected to the data lines DL1 through DLm. The leakage currents I_I may change the voltages of the data lines DL1 through DLm from the initialization voltage Vint to second voltages V2_D1 through V2_Dm.

In the second voltage sensing period, the voltage ADC 500 may receive the voltage levels (i.e., data signals) of the data lines DL1 through DLm as analog sensing signals, convert the analog sensing signals into digital sensing signals, and transmit the digital sensing signals to the memory 230 of the control unit 200.

In a data rewriting period, the data switch SW_D may be turned on, and the sensing switch SW_S may be turned off. That is, in the data rewriting period, the data switching unit 800 may connect the data lines DL1 through DLm to the data driver 400 and disconnect the data lines DL1 through DLm from the voltage ADC 500.

The data driver 400 may output again the data output signals DO1 through DOm which were transmitted to the pixels Pi1 through Pim connected to the $i^{th}$ scan line SLi before the sensing operation, and the pixels Pi1 through Pim may emit light corresponding to the original data signals. In some embodiments, if the sensing operation is performed in the standby period from the end of one frame to a next frame, the data rewriting period may be omitted.

A series of sensing operations on the pixels Pi1 through Pim connected to at least one scan line SLi may be performed within one frame. This is because amounts of current leaked to other pixels not sensed vary according to levels of data voltages applied to the unsensed pixels and amounts of driving current flowing in response to the data voltages. Therefore, if the first voltage sensing period and the second voltage sensing period exist in different frames, the amounts of leakage current and voltage changes of the data lines DL1 through DLm due to the leakage currents may be different in the first voltage sensing period and the second voltage sensing period.

In addition, the first voltage sensing period and the second voltage sensing period may have substantially the same (e.g., equal) lengths or durations. The generation of leakage currents and the voltage variations of the data lines DL1 through DLm due to the leakage currents may be continued during the first voltage sensing period and the second voltage sensing period. Therefore, if the lengths or durations of the first voltage sensing period and the second voltage sensing period are substantially the same (e.g., equal), the amounts of leakage current and the voltage variations of the data lines DL1 through DLm due to the leakage currents may be substantially the same (e.g., equal) in the first voltage sensing period and the second voltage sensing period.

The image data corrector 220 may read from the memory 230 the digital sensing signals corresponding to the first voltages V1_D1 through V1_Dm received during the first voltage sensing period and the digital sensing signals corresponding to the second voltages V2_D1 through V2_Dm received during the second voltage sensing period. Then, the image data corrector 220 may identify voltages having voltage variations due to leakage currents removed from the first voltages V1_D1 through V1_Dm based on the digital sensing signals corresponding to the second voltages V2_D1 through V2_Dm.

For example, in some embodiments, the initialization voltage Vint may be a predetermined voltage and may be applied equally to the pixels Pi1 through Pim connected to the $i^{th}$ scan line SLi. Differences between the initialization voltage Vint and the sensed second voltages V2_D1 through V2_Dm may correspond to leakage voltages $\Delta V_{leakage}$_D1 through $\Delta V_{leakage}$_Dm corresponding to currents leaked from the data lines DL1 through DLm, respectively. Therefore, by subtracting the second voltages V2_D1 through V2_Dm from the first voltages V1_D1 through V1_Dm sensed from the data lines DL1 through DLm and then adding the initialization voltage (e.g., a predetermined initialization voltage) Vint to the subtraction results, it is possible to identify voltages having the leakage voltages $\Delta V_{leakage_}D1$ through $\Delta V_{leakage_}Dm$ (corresponding to the leakage currents) removed from the first voltages V1_D1 through V1_Dm sensed from the data lines DL1 through DLm.

The first voltages V1_D1 through V1_Dm that a plurality of pixels provide to the data lines DL1 through DLm may be voltage signals that reflect respective characteristic differences of the pixels. The control unit 200 may identify voltages having leakage voltage components removed from the first voltages V1_D1 through V1_Dm based on the sensed first voltages V1_D1 through V1_Dm and the sensed second voltages V2_D1 through V2_Dm and output the corrected image data IMAGE' by compensating the original image data IMAGE for the respective characteristic differences of the pixels using the identified voltages.

For example, in the first voltage sensing period, the pixels Pi1 through Pim connected to the $i^{th}$ scan line SLi may apply voltages containing threshold voltage (Vth) components of the driving transistors to the data lines DL1 through DLm, and the voltage levels (i.e., data signals) of the data lines DL1 through DLm may be charged as the first voltages V1_D1 through V1_Dm. When the pixels Pi1 through Pim operate in a low (e.g., relatively low) gray level area, that is, when the voltage levels of the data signals transmitted to the driving transistors are low (e.g., relatively low), the threshold voltages Vth of the driving transistors will have a relatively large effect on the gray levels or characteristics of the pixels Pi1 through Pim.

In addition, in the first voltage sensing period, the pixels Pi1 through Pim connected to the $i^{th}$ scan line SLi may provide the data lines DL1 through DLm with currents corresponding to data signals which correspond to a specific gray level, for example, a maximum gray level of light emitted by an organic light-emitting diode. Accordingly, the data lines DL1 through DLm may be charged with the first voltages V1_D1 through V1_Dm. When the pixels Pi1 through Pim operate in a high (e.g., relatively high) gray level area, that is, when the voltage levels of the data signals transmitted to the driving transistors are high (e.g., relatively high), the threshold voltages Vth of the driving transistors will have a relatively small effect on the gray levels or characteristics of the pixels Pi1 through Pim. On the other hand, coefficients of other characteristics (e.g., charge mobility, gate capacitance, channel widths and channel lengths, etc.) of the driving transistors will have a relatively large effect on the gray levels or characteristics of the pixels Pi1 through Pim.

In some embodiments of the present invention, the control unit 200 may identify characteristic differences of a plurality of pixels in the low gray level area and characteristic differences of the pixels in the high gray level area and generate correction reference values by combining the identified characteristic differences in the low gray level area and the high gray level area.

That is, in order to identify the characteristic differences of the pixels in the low gray level area, the first initialization period, the first voltage sensing period, the second initialization period and the second voltage sensing period may be performed within one frame as described above. Then, a third initialization period, a third voltage sensing period, a fourth initialization period, and a fourth voltage sensing period may be performed in order to identify the characteristic differences of the pixels in the high gray level area.

An implementation example of the above-mentioned pixels and a data voltage sensing method will now be described in detail with reference to FIGS. 4 through 6.

Figure 4:
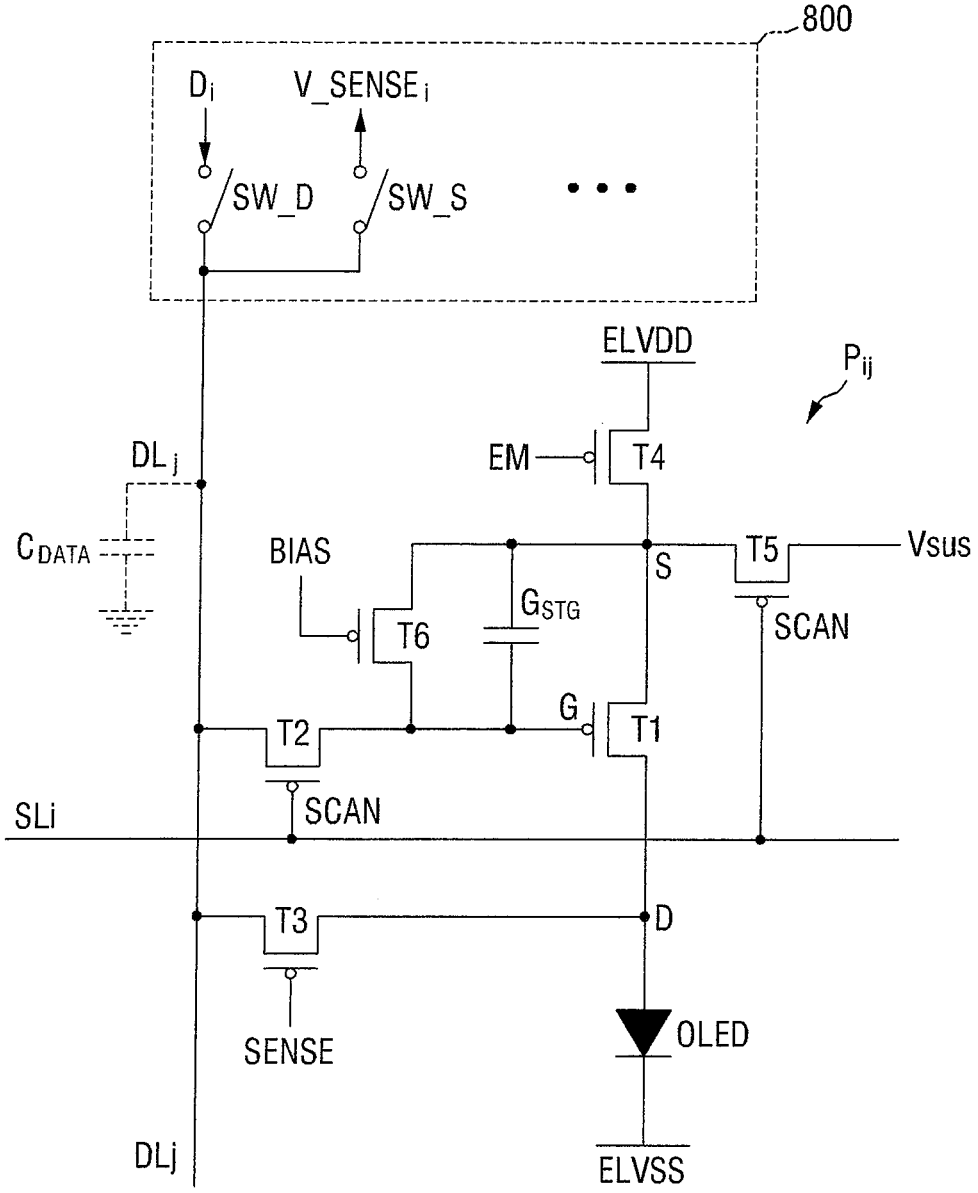
FIG. 4 is a circuit diagram of a pixel of the display panel of the organic light-emitting display of FIG. 1, a data line and a scan line connected to the pixel, and a data switching unit (or a data switch)

FIG. 4 is a circuit diagram of a pixel of the display panel 100 of the organic light-emitting display of FIG. 1, a data line and a scan line connected to the pixel, and the data switching unit 800.

Figure 5:
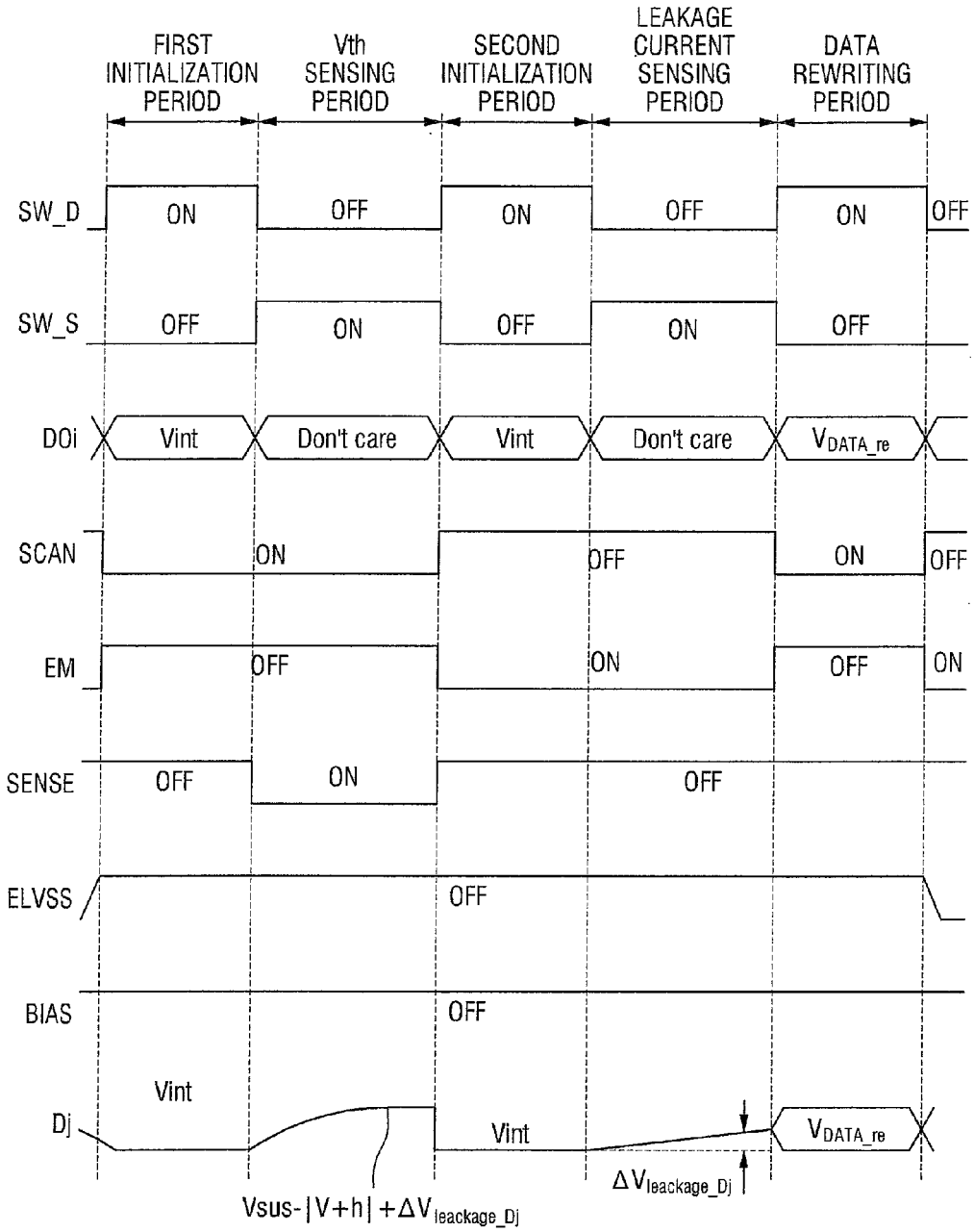
FIG. 5 is a timing diagram illustrating a data voltage sensing operation of the circuit of FIG. 4 in a low gray level area.

FIG. 5 is a timing diagram illustrating a data voltage sensing operation of the circuit diagram of FIG. 4 in a low gray level area.

Figure 6:
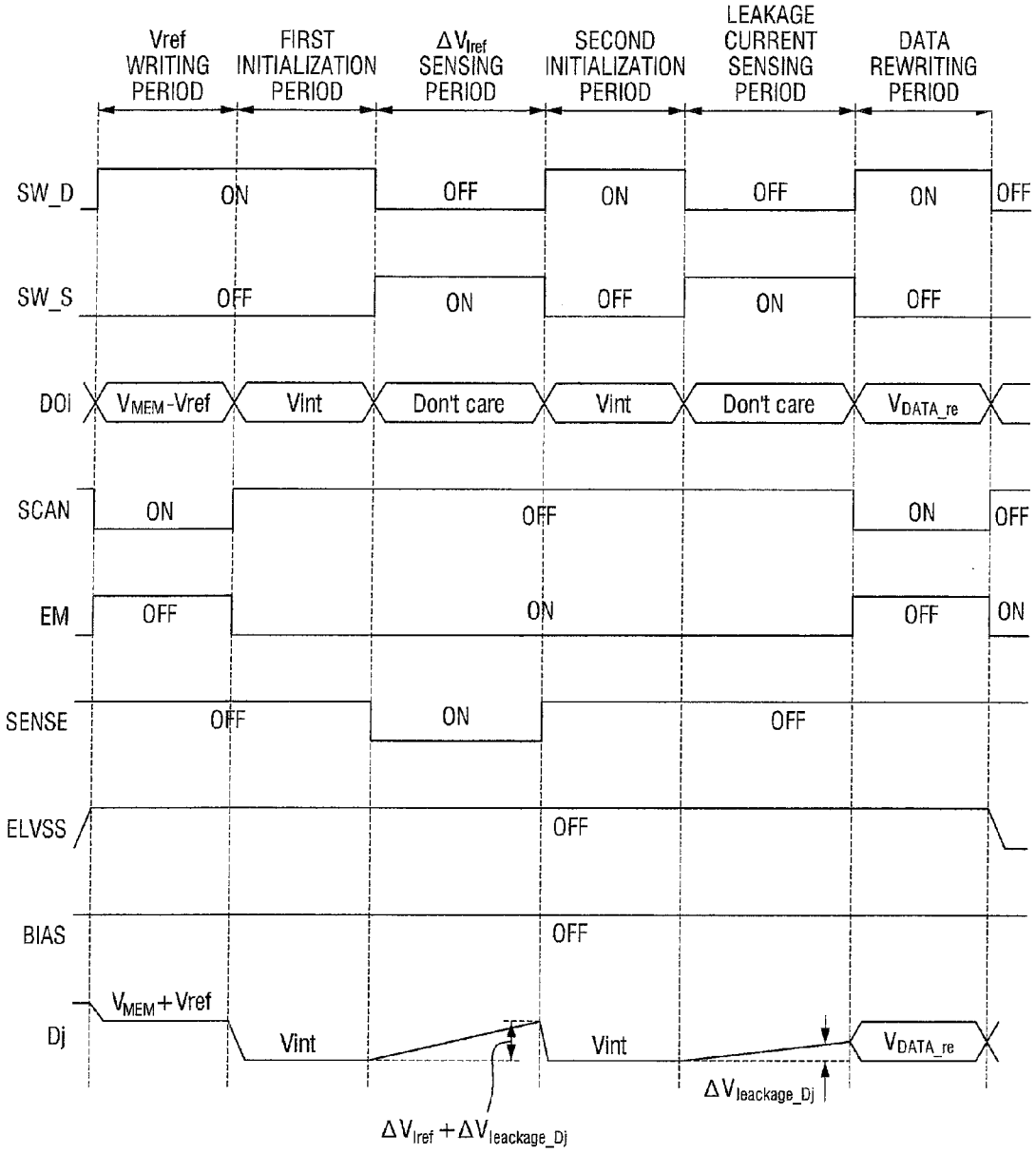
FIG. 6 is a timing diagram illustrating a data voltage sensing operation of the circuit of FIG. 4 in a high gray level area.

FIG. 6 is a timing diagram illustrating a data voltage sensing operation of the circuit diagram of FIG. 4 in a high gray level area.

In FIG. 4, one Pij of a plurality of pixels of the display panel 100, a scan line SLi and a data line DLj connected to the pixel Pij, and other signal lines are illustrated.

Referring to the circuit diagram of FIG. 4, the pixel Pij of the display panel 100 may include first through sixth transistors T1 through T6, and the first through sixth transistors T1 through T6 may be p-channel metal oxide semiconductor (PMOS) transistors.

The first transistor T1 may be a transistor that adjusts the amount of current supplied to an organic light-emitting diode and may correspond to a driving transistor mentioned above with reference to FIGS. 1 through 3. A node S connected to a source terminal of the first transistor T1 may be connected to a drain terminal of the fourth transistor T4, and the source terminal of the first transistor T1 may be connected to the first power source ELVDD via the fourth transistor T4. A node D connected to a drain terminal of the first transistor T1 may be connected to an anode of the organic light-emitting diode, and the drain terminal of the first transistor T1 may be connected to the second power source ELVSS via the organic light-emitting diode.

During the light emission of the organic light-emitting diode, the second power source ELVSS may have a lower voltage level than the first power source ELVDD, a driving current flowing through the first transistor T1 may be generated by a voltage difference between the first power source ELVDD and the second power source ELVSS, and the first transistor T1 may operate in a saturated area.

The second transistor T2 may be a transistor that switches to control whether or not a node G connected to a gate terminal of the first transistor T1 is connected (e.g., electrically connected) to the data line DLj. The second transistor T2 may correspond to a switching transistor mentioned above with reference to FIGS. 1 through 3. A drain terminal of the second transistor T2 may be connected to the node G connected to the gate terminal of the first transistor T1, and a source terminal of the second transistor T2 may be connected to the data line DLj. A gate terminal of the second transistor T2 may be connected to the scan line SLi and may receive a scan signal SCAN from the scan line SLi.

The third transistor T3 may be a transistor that switches to control whether or not the drain terminal of the first transistor T1 and the node D connected to the anode of the organic light-emitting diode is connected (e.g., electrically connected) to the data line DLj. A source terminal of the third transistor T3 may be connected to the node D connected to the drain terminal of the first transistor T1, and a drain terminal of the third transistor T3 may be connected to the data line DLj. A sensing voltage SENSE may be applied to a gate terminal of the third transistor T3, and the third transistor T3 may switch to control whether or not the node D connected to the drain terminal of the first transistor T1 is connected (e.g., electrically connected) to the data line DLj in response to the sensing voltage SENSE.

The fourth transistor T4 is a transistor that switches to control whether or not the node S connected to the source terminal of the first transistor T1 is connected (e.g., electrically connected) to the first power source ELVDD. That is, the fourth transistor T4 may allow or block the supply of a voltage or current to the first transistor T1 and serve as a switch that rapidly turns the organic light-emitting diode on or off.

The drain terminal of the fourth transistor T4 may be connected to the node S connected to the source terminal of the first transistor T1, and a source terminal of the fourth transistor T4 may be connected to the first power source ELVDD. A gate terminal of the fourth transistor T4 may be connected to an emission voltage EM, and the fourth transistor T4 may switch to control whether or not the first power source ELVDD is connected (e.g., electrically connected) to the node S connected to the source terminal of the first transistor T1 in response to the emission voltage EM.

The fifth transistor T5 is a transistor that switches to control whether or not a sustain voltage Vsus is applied to the node S connected to the source terminal of the first transistor T1. The sustain voltage Vsus may be applied to a source terminal of the fifth transistor T5, and a drain terminal of the fifth transistor T5 may be connected to the node S connected to the source terminal of the first transistor T1. A gate terminal of the fifth transistor T5 may be connected to the scan line SLi. The gate terminal of the fifth transistor T5 may receive the scan signal SCAN from the scan line SLi and switch to control whether to turn on or off the fifth transistor T5 based on the scan signal SCAN.

The sixth transistor T6 is a transistor that switches to control whether or not the node G connected to the gate terminal of the first transistor T1 is connected (e.g., electrically connected) to the node S connected to the source terminal of the first transistor T1. A source terminal of the fifth transistor T6 may be connected to the node S connected to the source terminal of the first transistor T1, and a drain terminal of the sixth transistor T6 may be connected to the node G connected to the gate terminal of the first transistor T1. A bias voltage BIAS may be applied to a gate terminal of the sixth transistor T6, and the sixth transistor T6 may connect or disconnect the node S connected to the source terminal of the first transistor T1 and the node G connected to the gate terminal of the first transistor T1 to or from each other in response to the bias voltage BIAS.

A storage capacitor $C_{STG}$ may be connected in parallel to the sixth transistor T6. Respective terminals of the storage capacitor $C_{STG}$ may be connected to the node S connected to the source terminal of the first transistor T1 and the node G connected to the gate terminal of the first transistor T1.

With reference to FIG. 5, a description will now be given of a low gray level sensing operation for sensing a voltage related to the threshold voltage Vth of the first transistor T1 when the pixel Pij operates in the low gray level area, that is, when the voltage level of a data signal Dj transmitted to the gate terminal of the first transistor T1 is low (e.g., relatively low).

Referring to FIG. 5, the low gray level sensing operation may include a first initialization period, a threshold voltage sensing period, a second initialization period, a leakage current sensing period, and a data rewriting period. In some embodiments, the data rewriting period may be omitted.

In all periods of the low gray level sensing operation, the second power source ELVSS and the bias voltage BIAS may maintain a high voltage (e.g., a turn-off voltage). Accordingly, in all periods of the low gray level sensing operation, a current may be blocked from flowing through the organic light-emitting diode, and the sixth transistor T6 may be turned off.

In the first initialization period, the data switch SW_D may be turned on, and the sensing switch SW_S may be turned off. That is, in the first initialization period, the data switching unit 800 may connect the data lines DL1 through DLm to the data driver 400 and disconnect the data lines DL1 through DLm from the voltage ADC 500.

In the first initialization period, the data driver 400 may output the initialization voltage Vint as the data output signals DO1 through DOm in response to the data control signal DCS from the timing controller 210, and data signals corresponding to the initialization voltage Vint may be provided to all data lines DL1 through DLm.

In the first initialization period, the scan voltage (signal) SCAN may maintain a low voltage (e.g., a turn-on voltage), the emission voltage EM may maintain a high voltage (e.g., a turn-off voltage), and the sensing voltage SENSE may maintain a high voltage (e.g., a turn-off voltage).

Accordingly, the second transistor T2 and the fifth transistor T5 may be turned on, the fourth transistor T4 may be turned off, and the third transistor T3 may be turned off.

Therefore, in the first initialization period, the initialization voltage Vint may be applied to the data line DLj and the node G connected to the gate terminal of the first transistor T1, and the sustain voltage Vsus may be applied to the node S connected to the source terminal of the first transistor T1.

In the threshold voltage sensing period, the data switch SW_D may be turned off, and the sensing switch SW_S may be turned on. That is, in the threshold voltage sensing period, the data switching unit 800 may disconnect the data lines DL1 through DLm from the data driver 400 and connect the data lines DL1 through DLm to the voltage ADC 500.

In the threshold voltage sensing period, the scan voltage SCAN may maintain a low voltage (e.g., a turn-on voltage), the emission voltage EM may maintain a high voltage (e.g., a turn-off voltage), and the sensing voltage SENSE may maintain a low voltage (e.g., a turn-on voltage).

Accordingly, the second transistor T2 and the fifth transistor T5 may be turned on, the fourth transistor T4 may be turned off, and the third transistor T3 may be turned on.

That is, the node G connected to the gate terminal of the first transistor T1 and the node D connected to the drain terminal of the first transistor T1 may be electrically conducted to each other via the third transistor T3, the data line DLj, and the second transistor T2. Accordingly, a diode connection in which the drain terminal and the gate terminal of the first transistor T1 are connected may be formed in the first transistor T1. Since the first transistor T1 forms the diode connection and the sustain voltage Vsus is applied to the source terminal of the first transistor T1, a voltage applied to the gate terminal or the drain terminal of the first transistor T1 corresponds to Vsus−|Vth|. Therefore, the voltage level of the data line DLj increases to Vsus−|Vth|. Here, |Vth| represents an absolute value of the threshold voltage Vth of the first transistor T1, and Vsus represents the sustain voltage Vsus provided by the fifth transistor T5.

In some embodiments, the sustain voltage Vsus has a predetermined value and is applied equally to a plurality of pixels. The voltage ADC 500 may identify the voltage level of the first transistor T1 by sensing the level (Vsus−|Vth|) of the voltage charged in the data line DLj during the threshold voltage sensing period. However, as described above with reference to FIGS. 1 through 3, a current may leak to other pixels P1j through Pnj connected to the data line DLj and not sensed. Therefore, the level of the voltage charged in the data line DLj should reflect a leakage voltage difference component $\Delta V_{leackage_Dj}$ corresponding to an error due to the leakage current. Accordingly, the voltage level of the data line DLj sensed by the voltage ADC 500 may be $Vsus-|Vth|+\Delta V_{leackage_Dj}$.

The voltage ADC 500 may receive the voltage level ($Vsus-|Vth|+\Delta V_{leackage_Dj}$) of the data line DLj as an analog signal, convert the analog signal into a digital sensing signal, and transmit the digital sensing signal to the memory 230 of the control unit 200.

In the second initialization period, the data switch SW_D may be turned on, and the sensing switch SW_S may be turned off. That is, in the second initialization period, the data switching unit 800 may connect the data lines DL1 through DLm to the data driver 400 and disconnect the data lines DL1 through DLm from the voltage ADC 500.

In the second initialization period, the data driver 400 may output the initialization voltage Vint as the data output signals DO1 through DOm in response to the data control signal DCS from the timing controller 210, and data signals corresponding to the initialization voltage Vint may be provided to all data lines DL1 through DLm.

In the second initialization period, the scan voltage SCAN may maintain a high voltage (e.g., a turn-off voltage), the emission voltage EM may maintain a low voltage (e.g., a turn-on voltage), and the sensing voltage SENSE may maintain a high voltage (e.g., a turn-off voltage).

Accordingly, the second transistor T2, the third transistor T3 and the fifth transistor T5 may be turned off, and the fourth transistor T4 may be turned on.

Therefore, in the second initialization period, the initialization voltage Vint may be applied to the data line DLj, and the data line DLj may be disconnected from the pixel Pij.

In the leakage current sensing period, the data switch SW_D may be turned off, and the sensing switch SW_S may be turned on. That is, in the leakage current sensing period, the data switching unit 800 may disconnect the data lines DL1 through DLm from the data driver 400 and connect the data lines DL1 through DLm to the voltage ADC 500.

In the leakage current sensing period, the scan voltage SCAN may maintain a high voltage (e.g., a turn-off voltage), the emission voltage EM may maintain a low voltage (e.g., a turn-on voltage), and the sensing voltage SENSE may maintain a high voltage (e.g., a turn-off voltage).

Accordingly, the second transistor T2, the third transistor T3 and the fifth transistor T5 may be turned off, and the fourth transistor T4 may be turned on.

That is, the data line DLj and the pixel Pij may be disconnected from each other, and the initialization voltage Vint charged in the data line DLj during the second initialization period may leak to the pixels P1*j* through Pnj connected to the data line DLj during the leakage current sensing period. Accordingly, the voltage level of the data line DLj may be $Vint-\Delta V_{leackage_Dj}$ obtained by subtracting the leakage voltage difference $\Delta V_{leackage_Dj}$ due to the leakage current from the initialization voltage Vint.

In the leakage current sensing period, the voltage ADC 500 may receive the voltage level ($Vint-\Delta V_{leackage_Dj}$) of the data line DLj as an analog signal, convert the analog signal into a digital sensing signal, and transmit the digital sensing signal to the memory 230 of the control unit 200.

In some embodiments, the initialization voltage Vint has a predetermined value and is applied equally to a plurality of pixels. Accordingly, in the leakage current sensing period, the control unit 200 can accurately sense the leakage voltage difference $\Delta V_{leackage_Dj}$ due to the leakage current from the voltage level ($Vint-\Delta V_{leackage_Dj}$) of the sensed data line DLj.

For example, in some embodiments, the control unit 200 can identify a voltage containing the threshold voltage component of the first transistor T1 by subtracting the voltage level ($Vint-\Delta V_{leackage_Dj}$) of the data line DLj sensed during the leakage current sensing period from the voltage level ($Vsus-|Vth|+\Delta V_{leackage_Dj}$) of the data line DLj sensed during the threshold voltage sensing period and then adding the predetermined value of the initialization voltage Vint to the subtraction result ($(Vsus-|Vth|+\Delta V_{leackage_Dj})-Vint-\Delta V_{leackage_Dj}$).

That is, the control unit 200 can produce an equation of $(Vsus-|Vth|+\Delta V_{leackage_Dj})-Vint-\Delta V_{leackage_Dj}+Vint=(Vsus-|Vth|)$. In some embodiments, because the sustain voltage Vsus also has a predetermined value, the control unit 200 can identify the threshold voltage Vth of the first transistor T1 that reflects the leakage current.

The control unit 200 may identify a $Vsus-|Vth|$ value corresponding to each pixel and store the identified $Vsus-|Vth|$value in the memory 230. The $Vsus-|Vth|$ value of each pixel stored in the memory 230 will hereinafter be referred to as a memorized voltage $V_{MEM}$.

A series of low gray level sensing operations on at least one pixel Pij may be performed within one frame. This is because amounts of current leaked to other pixels not sensed vary according to levels of data voltages applied to the unsensed pixels and amounts of driving current flowing in response to the data voltages. Therefore, if the threshold voltage sensing period and the leakage current sensing period exist in different frames, the amounts of leakage current and voltage changes of the data lines DL1 through DLm due to the leakage currents may be different in the threshold voltage sensing period and the leakage current sensing period.

In addition, the threshold voltage sensing period and the leakage current sensing period may have substantially the same (e.g., equal) lengths or durations. The generation of leakage currents and the voltage variations of the data lines DL1 through DLm due to the leakage currents may be continued during the threshold voltage sensing period and the leakage current sensing period. Therefore, if the lengths or durations of the threshold voltage sensing period and the leakage current sensing period are substantially the same (e.g., equal), the amounts of leakage current and the voltage variations of the data lines DL1 through DLm due to the leakage currents may be substantially the same (e.g., equal) in the threshold voltage sensing period and the leakage current sensing period.

In the data rewriting period, the data switch SW_D may be turned on, and the sensing switch SW_S may be turned off. That is, in the data rewriting period, the data switching unit 800 may connect the data lines DL1 through DLm to the data driver 400 and disconnect the data lines DL1 through DLm from the voltage ADC 500.

The data driver 400 may output again the data output signals DO1 through DOm which were transmitted to the pixels Pi1 through Pim connected to the $i^{th}$ scan line SLi before the sensing operation, and the pixels Pi1 through Pim may emit light corresponding to the original data signals. In some embodiments, if the sensing operation is performed in the standby period from the end of one frame to a next frame, the data rewriting period may be omitted.

With reference to FIG. 6, a description will now be given of a high gray level sensing operation for identifying a characteristic difference of the first transistor T1 when the pixel Pij operates in the high gray level area, that is, when a relatively large current flows through the first transistor T1.

Referring to FIG. 6, the high gray level sensing operation may include a reference voltage (Vref) writing period, a first initialization period, a reference charged voltage difference ($\Delta V_{Iref}$) sensing period, a second initialization period, a leakage current sensing period, and a data rewriting period. In some embodiments, the data rewriting period may be omitted.

In all periods of the high gray level sensing operation, the second power source ELVSS and the bias voltage BIAS may maintain a high voltage (e.g., a turn-off voltage). Accordingly, in all periods of the high gray level sensing operation, a current may be blocked from flowing through the organic light-emitting diode, and the sixth transistor T6 may be turned off.

In the reference voltage writing period, the data switch SW_D may be turned on, and the sensing switch SW_S may be turned off. That is, in the reference voltage writing period, the data switching unit 800 may connect the data lines DL1 through DLm to the data driver 400 and disconnect the data lines DL1 through DLm from the voltage ADC 500.

In the reference voltage writing period, the data driver 400 may output a voltage signal obtained by subtracting a reference voltage Vref from the memorized voltage $V_{MEM}$ recorded in the memory 230 during the low gray level sensing operation as a data output signal in response to the data control signal DCS from the timing controller 210. A data signal corresponding to the voltage signal obtained by subtracting the reference voltage Vref from the memorized voltage $V_{MEM}$ may be transmitted to each data line.

In the reference voltage writing period, the scan voltage SCAN may maintain a low voltage (e.g., a turn-on voltage), the emission voltage EM may maintain a high voltage (e.g., a turn-off voltage), and the sensing voltage SENSE may maintain a high voltage (e.g., a turn-off voltage).

Accordingly, the second transistor T2 and the fifth transistor T5 may be turned on, the fourth transistor T4 may be turned off, and the third transistor T3 may be turned off.

Therefore, in the reference voltage writing period, the voltage ($V_{MEM}$−Vref) obtained by subtracting the reference voltage Vref from the memorized voltage $V_{MEM}$ may be applied to the data line DLj and the node G connected to the gate terminal of the first transistor T1, and the sustain voltage Vsus may be applied to the node S connected to the source terminal of the first transistor T1.

In the first initialization period, the data switch SW_D may be turned on, and the sensing switch SW_S may be turned off. That is, in the first initialization period, the data switching unit 800 may connect the data lines DL1 through DLm to the data driver 400 and disconnect the data lines DL1 through DLm from the voltage ADC 500.

In the first initialization period, the data driver 400 may output the initialization voltage Vint as the data output signals DO1 through DOm in response to the data control signal DCS from the timing controller 210, and data signals corresponding to theinitialization voltage Vint may be provided to all data lines DL1 through DLm.

In the first initialization period, the scan voltage SCAN may maintain a high voltage (e.g., a turn-off voltage), the emission voltage EM may maintain a low voltage (e.g., a turn-on voltage), and the sensing voltage SENSE may maintain a high voltage (e.g., a turn-off voltage).

Accordingly, the second transistor T2, the third transistor T3 and the fifth transistor T5 may be turned on, and the fourth transistor T4 may be turned off.

Therefore, in the first initialization period, the data line DLj may be electrically disconnected from the pixel Pij by the turned-off second and third transistors T2 and T3, and the data line DLj may be maintained at the level of the initialization voltage Vint. In addition, the node S connected to the source terminal of the first transistor T1 may be connected to the first power source ELVDD by the fourth transistor T4, and the voltage level of the node S connected to the source terminal of the first transistor T1 may be substantially the same as (e.g., equal to) the voltage level of the first power source ELVDD. In addition, since the storage capacitor $C_{STG}$ is charged with a voltage difference of ($V_{MEM}$−Vref)−Vsus in the reference voltage writing period, the node S connected to the source terminal of the first transistor T1 may have a voltage level of ($V_{MEM}$−Vref)−Vsus+ELVDD=(Vsus−|Vth|−Vref)−Vsus+ELVDD=ELVDD−Vref−|Vth|.

In the reference charged voltage difference sensing period, the data switch SW_D may be turned off, and the sensing switch SW_S may be turned on. That is, in the reference charged voltage difference sensing period, the data switching unit 800 may disconnect the data lines DL1 through DLm from the data driver 400 and connect the data lines DL1 through DLm to the voltage ADC 500.

In the reference charged voltage difference sensing period, the scan voltage SCAN may maintain a high voltage (e.g., a turn-off voltage), the emission voltage EM may maintain a low voltage (e.g., a turn-on voltage), and the sensing voltage SENSE may maintain a low voltage (e.g., a turn-on voltage).

Accordingly, the second transistor T2 and the fifth transistor T5 may be turned off, and the third transistor T3 and the fourth transistor T4 may be turned on.

That is, the node D connected to the drain terminal of the first transistor T1 and the data line DLj may be electrically connected with each other, and a driving current $I_{T1}$ flowing through the first transistor T1 may charge the data line DLj. In the reference charged voltage difference sensing period, the degree of variation in the voltage level of the data line DLj may be represented by a reference charged voltage difference $\Delta V_{Iref}$.

Here, the reference charged voltage difference $\Delta V_{Iref}$ may be given by Equation (2):

$$\Delta V_{Iref} = \frac{t_s \cdot I_{T1}}{C_{DATA}}, \tag{2}$$

where $t_s$ is the duration of the reference charged voltage difference sensing period, and $C_{DATA}$ is capacitance of the data line DLj. In an embodiment of the present invention, the reference charged voltage difference sensing period and the leakage current sensing period may have substantially the same (e.g., equal) lengths or durations. Therefore, $t_s$ may also represent the duration of the leakage current sensing period. In some embodiments, the initialization voltage Vint has a predetermined value and is applied equally to a plurality of pixels. Therefore, the voltage ADC 500 can identify the reference charged voltage difference $\Delta V_{Iref}$ by sensing the level (Vint+$\Delta V_{Iref}$) of the voltage charged in the data line DLj during the reference charged voltage difference sensing period. However, as described above with reference to FIGS. 1 through 3, a current may leak to other pixels P1*j* through Pnj connected to the data line DLj and not sensed. Therefore, the level of the voltage charged in the data line DLj should reflect the leakage voltage difference component $\Delta V_{leackage_Dj}$ corresponding to an error due to the leakage current. Accordingly, the voltage level of the data line DLj sensed by the voltage ADC 500 may be Vint+$\Delta V_{Iref}$+$\Delta V_{leackage_Dj}$.

The voltage ADC 500 may receive the voltage level (Vint+$\Delta V_{Iref}$ $\Delta V_{leackage_Dj}$) of the data line DLj as an analog signal, convert the analog signal into a digital sensing signal, and transmit the digital sensing signal to the memory 230 of the control unit 200.

In the second initialization period, the data switch SW_D may be turned on, and the sensing switch SW_S may be turned off. That is, in the second initialization period, the data switching unit 800 may connect the data lines DL1 through DLm to the data driver 400 and disconnect the data lines DL1 through DLm from the voltage ADC 500.

In the second initialization period, the data driver 400 may output the initialization voltage Vint as the data output signals DO1 through DOm in response to the data control signal DCS from the timing controller 210, and data signals corresponding to the initialization voltage Vint may be provided to all data lines DL1 through DLm.

In the second initialization period, the scan voltage SCAN may maintain a high voltage (e.g., a turn-off voltage), the emission voltage EM may maintain a low voltage (e.g., a turn-on voltage), and the sensing voltage SENSE may maintain a high voltage (e.g., a turn-off voltage).

Accordingly, the second transistor T2, the third transistor T3 and the fifth transistor T5 may remain turned off, and the fourth transistor T4 may remain turned on.

Therefore, in the second initialization period, the initialization voltage Vint may be applied to the data line DLj, and the data line DLj may be disconnected from the pixel Pij.

In the leakage current sensing period, the data switch SW_D may be turned off, and the sensing switch SW_S may be turned on. That is, in the leakage current sensing period, the data switching unit 800 may disconnect the data lines DL1 through DLm from the data driver 400 and connect the data lines DL1 through DLm to the voltage ADC 500.

In the leakage current sensing period, the scan voltage SCAN may maintain a high voltage (e.g., a turn-off voltage), the emission voltage EM may maintain a low voltage (e.g., a turn-on voltage), and the sensing voltage SENSE may maintain a high voltage (e.g., a turn-off voltage).

Accordingly, the second transistor T2, the third transistor T3 and the fifth transistor T5 may remain turned off, and the fourth transistor T4 may remain turned on.

That is, the data line DLj and the pixel Pij may be disconnected from each other, and the initialization voltage Vint charged in the data line DLj during the second initialization period may leak to the pixels P1*j* through Pnj connected to the data line DLj during the leakage current sensing period. Accordingly, the voltage level of the data line DLj may be Vint−$\Delta V_{leackage_Dj}$ obtained by subtracting the leakage voltage difference $\Delta V_{leackage_Dj}$ due to the leakage current from the initialization voltage Vint.

In the leakage current sensing period, the voltage ADC 500 may receive the voltage level (Vint−$\Delta V_{leackage_Dj}$) of the data line DLj as an analog signal, convert the analog signal into a digital sensing signal, and transmit the digital sensing signal to the memory 230 of the control unit 200.

In some embodiments, the initialization voltage Vint has a predetermined value and is applied equally to a plurality of pixels. Accordingly, in the leakage current sensing period, the control unit 200 can accurately sense the leakage voltage difference $\Delta V_{leackage_Dj}$ due to the leakage current from the voltage level (Vint-$\Delta V_{leackage_Dj}$) of the sensed data line DLj.

For example, the control unit 200 can identify the reference charged voltage difference $\Delta V_{Iref}$ without the leakage current component by subtracting the voltage level (Vint−$\Delta V_{leackage_Dj}$) of the data line DLj sensed during the leakage current sensing period from the voltage level (Vint+$\Delta V_{Iref}$ $\Delta V_{leackage_Dj}$) of the data line DLj sensed during the reference charged voltage difference sensing period.

The control unit 200 can identify the reference charged voltage difference $\Delta V_{Iref}$ of each pixel and store the identified reference charged voltage difference $\Delta V_{Iref}$ in the memory 230.

However, in an embodiment of the present invention, the reference charged voltage difference $\Delta V_{Iref}$ of each pixel may not be recorded in the memory 230. Instead, the reference charged voltage difference $\Delta V_{Iref}$ of each pixel may be compared with a target charged voltage difference $\Delta V_{I_target}$. Then, the reference voltage Vref of each pixel may be increased or decreased according to the comparison result, and the increased or decreased reference voltage Vref of each pixel may be stored in the memory 230. In another embodiment of the present invention, the reference voltage Vref of each pixel may be a fixed value, and an offset value for the reference voltage Vref may be stored in the memory 230 according to the comparison result between the sensed reference charged voltage difference $\Delta V_{Iref}$ and the target charged voltage difference $\Delta V_{I_target}$.

For example, the target charged voltage difference $\Delta V_{I_Target}$ may be given by Equation (3):

$$\Delta V_{Itarget} = \frac{t_s \cdot I_{ref}}{C_{DATA}}, \tag{3}$$

where $t_s$ corresponds to the duration of the reference charged voltage difference sensing period and the duration of the leakage current sensing period, and $C_{DATA}$ is capacitance of the data line DLj. Iref is a reference current value, for example, a current value corresponding to a reference data signal generated when a plurality of pixels of the display panel 100 operate ideally without characteristic differences. For example, Iref may be a driving current value for a data signal corresponding to a maximum gray value.

The control unit 200 compares the reference charged voltage difference $\Delta V_{Iref}$ of each pixel with the target charged voltage difference $\Delta V_{I_Target}$. Then, the control unit 200 reduces the driving current $I_{T1}$ flowing through each pixel whose reference charged voltage difference $\Delta V_{Iref}$ is smaller than the target charged voltage difference $\Delta V_{I_target}$ by decreasing the reference voltage Vref of the pixel. In addition, the control unit 200 increases the driving current $I_{T1}$ flowing through each pixel whose reference charged voltage difference $\Delta V_{Iref}$ is greater than the target charged voltage difference $\Delta V_{I_target}$ by increasing the reference voltage Vref of the pixel. The increased or decreased reference voltage Vref of each pixel may be recorded and updated in the memory 230.

The above high gray level sensing operation may be performed repeatedly, and the reference voltage Vref of each pixel may be cumulatively updated such that the reference charged voltage difference $\Delta V_{Iref}$ of each pixel gradually reaches the target charged voltage difference $\Delta V_{I_target}$.

That is, the repeated update of the reference voltage Vref of each pixel may cause the reference current Iref to be the same or substantially the same as the driving current $I_{T1}$ flowing through the first transistor T1.

The current flowing through the first transistor T1 of the pixel Pij may be given by Equation (4):

$$I_{ref} = \frac{1}{2}\mu C_{ox}\frac{W}{L}(V_{SG} - |V_{th}|)^2 \tag{4}$$

-continued $$= \frac{1}{2}\mu C_{ox}\frac{W}{L}(V_{ref} + |V_{th}| - |V_{th}|)^2$$

$$= \frac{1}{2}\mu C_{ox}\frac{W}{L}V_{ref}^2,$$

where μ, $C_{ox}$, W, and L respectively are charge mobility, gate capacitance per unit area, channel width and channel length of the first transistor T1, that is, unique characteristic coefficients of each transistor. It can be noted that Equation (4) has the threshold voltage component removed from Equation (1) which defines a driving current flowing through a driving transistor of a pixel.

Assuming that the threshold voltages Vth of the first transistors T1 of a plurality of pixels are not different or not significantly different, the threshold voltages Vth of the first transistors T1 of all pixels may have a voltage of, e.g., 0.3 V in the high gray level sensing operation, and the reference voltage Vref shown in Equation (4) may be identified through the high gray level sensing operation.

Alternatively, considering the differences between the threshold voltages Vth of the first transistors T1 of the pixels, the threshold voltage Vth of the first driving transistor T1 of each pixel may be sensed through the above-described low gray level sensing operation and then removed from the reference current Iref identified through the high gray level sensing operation.

When the driving current $I_{T1}$ flowing through the sensed first transistor T1 becomes the same or substantially the same as the reference driving current Iref by the repeated update of the reference voltage Vref of each pixel, the value of the updated reference voltage Vref, rearranged from Equation (4), may be given by Equation (5):

$$V_{ref} = \sqrt{\frac{2I_{ref}}{\mu C_{ox}\frac{W}{L}}}. \quad (5)$$

Values finally stored in the memory 230 may be values of the memorized voltage ($V_{MEM}$=Vsus−|Vth|) and reference voltage Vref of each pixel. These values may be continuously updated to compensate for changes in the characteristic difference of the first driving transistor T1 of each pixel over time.

A display operation of the organic light-emitting display performing the low gray level sensing operation and the high gray level sensing operation will now be described with reference to FIG. 7.

Figure 7:
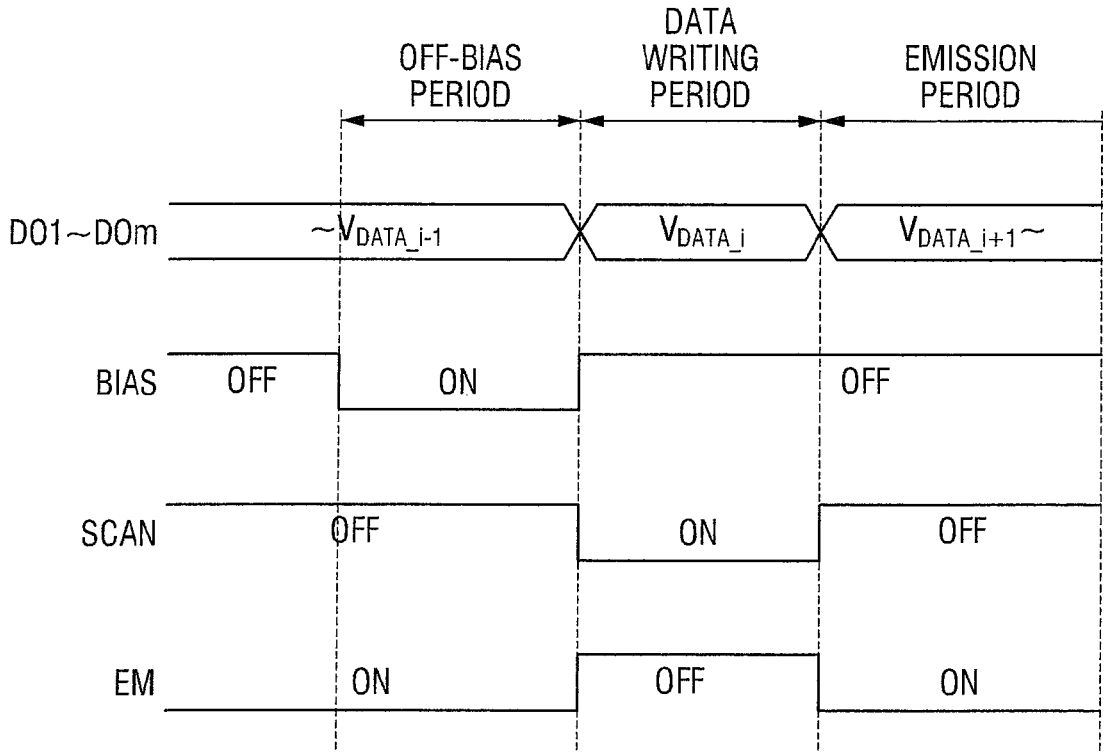
FIG. 7 is a timing diagram illustrating a display operation of the organic light-emitting display of FIG. 1.

FIG. 7 is a timing diagram illustrating a display operation of the organic light-emitting display of FIG. 1.

In FIG. 7, the display operation of the pixels Pi1 through Pim connected to the $i_{th}$ scan line SLi is illustrated as an example.

Referring to FIGS. 4 and 7, during the display operation of the organic light-emitting display according to the embodiment of FIG. 1, the data switch SW_D may be turned on, and the sensing switch SW_S may be turned off. The third transistor T3 may be turned off by the sensing voltage SENSE applied as a high voltage (e.g., a turn-off voltage), and the voltage of the second power source ELVSS may be sufficiently lower than that of the first power source ELVDD.

The display operation of the $i^{th}$ scan line SLi illustrated in FIG. 7 may include an off-bias period, a data writing period, and an emission period.

In the off-bias period, the bias voltage BIAS may maintain a turn-on voltage, the scan voltage SCAN of the $i^{th}$ scan line SLi may maintain a turn-off voltage, and the emission voltage EM may maintain a turn-on voltage.

That is, during the off-bias period, the sixth transistor T6 and the fourth transistor T4 may be turned on, and the second transistor T2 and the fifth transistor T5 may be turned off.

The sensing voltage SENSE may maintain a high voltage (e.g., a turn-off voltage) during the entire period of the display operation, and the third transistor T3 may remain turned off during the entire period of the display operation.

In the off-bias period, since the sixth transistor T6 is turned on, the first transistor T1 may remain in an off-biased state. That is, the voltage of the node S connected to the source terminal of the first transistor T1 may be the same or substantially the same as the voltage of the node G connected to the gate terminal of the first transistor T1. In addition, since a source-gate voltage Vgs of the first transistor T1 is zero, the first transistor T1 may remain turned off. In the off-bias period, since the fourth transistor T4 is turned on, the voltage of the node S connected to the source terminal of the first transistor T1 and the voltage of the node G connected to the gate terminal of the first transistor T1 may be at the same or substantially the same level as the voltage of the first power source ELVDD.

In the data writing period, the bias voltage BIAS may be a high voltage (e.g., a turn-off voltage), the scan voltage SCAN of the $i^{th}$ scan line SLi may be a low voltage (e.g., a turn-on voltage), and the emission voltage EM may be a high voltage (e.g., turn-off voltage).

That is, in the data writing period, the second transistor T2 and the fifth transistor T5 may be turned on, and the sixth transistor T6 and the fourth transistor T4 may be turned off. As described above, the third transistor T3 may remain turned off during the entire period of the display operation.

In the data writing period, the data driver 400 may output to the data lines DL1 through DLm the data output signals DO1 through DOm corresponding to data signals of the pixels Pi1 through Pim connected to the $i^{th}$ scan line SLi, and a data voltage Vdata may be applied to the node G connected to the gate terminal of the first transistor T1 of each of the pixels Pi1 through Pim connected to the $i^{th}$ scan line SLi.

In addition, in the data writing period, since the fifth transistor T5 is turned on, the sustain voltage Vsus may be applied to the node S connected to the source terminal of the first transistor T1.

In addition, since the sixth transistor T6 remains turned off, the storage capacitor $C_{STG}$ may be charged with a voltage corresponding to a difference between the data voltage Vdata and the sustain voltage Vsus.

Here, the data voltage Vdata applied to each of the pixels Pi1 through Pim may be determined using the memorized voltage $V_{MEM}$ stored in the memory 230 for each of the pixels Pi1 through Pim and the reference voltage Vref and may be given by Equation (6):

$$V_{data} = V_{MEM1} - V_{ref}\left(\frac{\text{D_data}}{2^{n-1}}\right)^{\frac{\gamma}{2}}, \quad (6)$$

where n is a bit number determining the number of gray levels that a pixel can express, D_data is a gray level expressed by each pixel in image data, and y is a gamma correction constant of, e.g., 2.2. In addition, when a pixel has 256 gray levels, n=8 (8 bits), and D_data may have a value of 0 to 255 according to a gray level expressed by the pixel.

In the emission period, the bias voltage BIAS may be a high voltage (e.g., a turn-off voltage), the scan voltage SCAN of the $i^{th}$ scan line SLi may be a high voltage (e.g., a turn-off voltage), and the emission voltage EM may be a low voltage (e.g., a turn-on voltage).

That is, in the data writing period, the second transistor T2, the sixth transistor T6 and the fifth transistor T5 may be turned off, and the fourth transistor T4 may be turned on. As described above, the third transistor T3 may remain turned off during the entire period of the display operation. The first transistor T1 may be turned on according to the level of the data voltage Vdata applied thereto, thereby providing a driving current to the organic light-emitting diode.

In the data writing period, since the fourth transistor T4 is turned on, the node S connected to the source terminal of the first transistor T1 may be connected to the first power source ELVDD, and the voltage of the node S connected to the source terminal of the first transistor T1 may be the same or substantially the same as the voltage of the first power source ELVDD. In addition, the node G connected to the gate terminal of the first transistor T1 may have a voltage level obtained by adding the voltage (ELVDD) applied to the node S connected to the source terminal of the first transistor T1 to the voltage (Vdata-Vsus) charged in the storage capacitor $C_{STG}$ during the data writing period.

That is, the voltage of the node G connected to the gate terminal of the first transistor T1 may be given by Equation (7):

$$\begin{aligned} V_G &= V_{data} - V_{SUS} + ELVDD \\ &= \left[V_{SUS} - |V_{th}| - V_{ref}\left(\frac{\text{D_data}}{2^{n-1}}\right)^{\frac{\gamma}{2}}\right] - V_{SUS} + ELVDD \\ &= ELVDD - |V_{th}| - V_{ref}\left(\frac{\text{D_data}}{2^{n-1}}\right)^{\frac{\gamma}{2}}. \end{aligned} \tag{7}$$

In the emission period, the organic light-emitting diode may emit light in response to the driving current flowing through the first transistor T1, and the driving current flowing through the first transistor T1 when the organic light-emitting diode emits light may be given by Equation (8):

$$\begin{aligned} I_{emission} &= \frac{1}{2}\mu C_{ox}\frac{W}{L}(V_{SG} - |V_{th}|)^2 \\ &= \frac{1}{2}\mu C_{ox}\frac{W}{L}(V_{SG} - |V_{th}|)^2 \\ &= \frac{1}{2}\mu C_{ox}\frac{W}{L}\left(ELVDD - \left[ELVDD - |V_{th}| - \sqrt{\frac{2I_{ref}}{\mu C_{ox}\frac{W}{L}}}\left(\frac{\text{D_data}}{2^{n-1}}\right)^{\frac{\gamma}{2}}\right] - |V_{th}|\right)^2 \\ &= I_{ref}\left(\frac{\text{D_data}}{2^{n-1}}\right)^{\gamma}. \end{aligned} \tag{8}$$

Here, the reference current Iref may correspond to a driving current generated when the first transistors T1 of a plurality of pixels operate ideally without characteristic differences, for example, a driving current generated during light emission at a maximum gray level. Therefore, a driving current $I_{emission}$ of the first transistor T1 during light emission may generate a current irrelevant to other characteristic coefficients such as threshold voltage Vth and charge mobility. Accordingly, this may improve the luminance uniformity of the pixels of the display panel 100 of the organic light-emitting display device.

An organic light-emitting display according to another embodiment of the present invention will now be described with reference to FIGS. 8 and 9.

Figure 8:
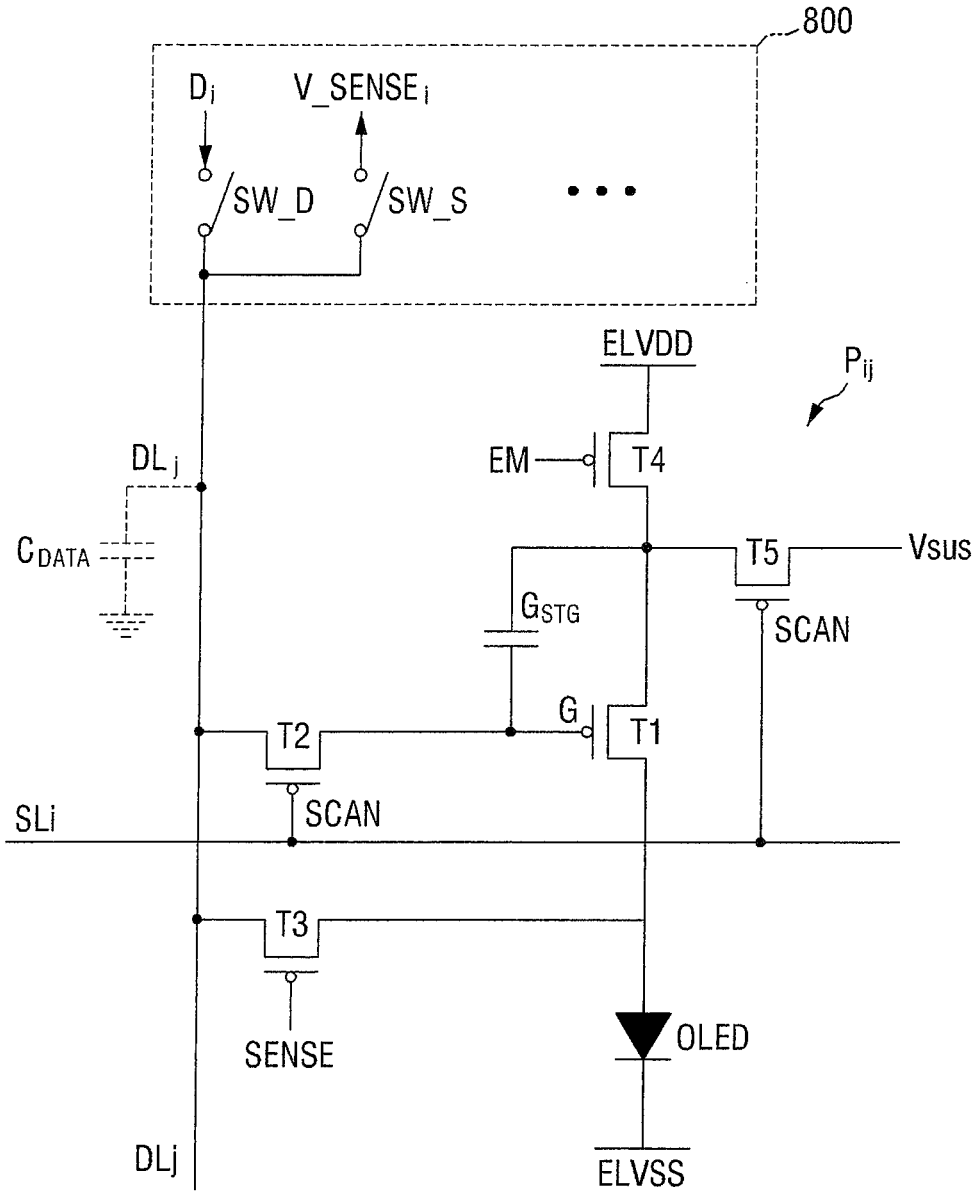
FIG. 8 is a circuit diagram of a pixel of a display panel of an organic light-emitting display according to another embodiment of the present invention, a data line and a scan line connected to the pixel, and a data switching unit (or a data switch)

FIG. 8 is a circuit diagram of a pixel of a display panel 100 of an organic light-emitting display according to another embodiment of the present invention, a data line and a scan line connected to the pixel, and a data switching unit (or a data switch) 800.

Figure 9:
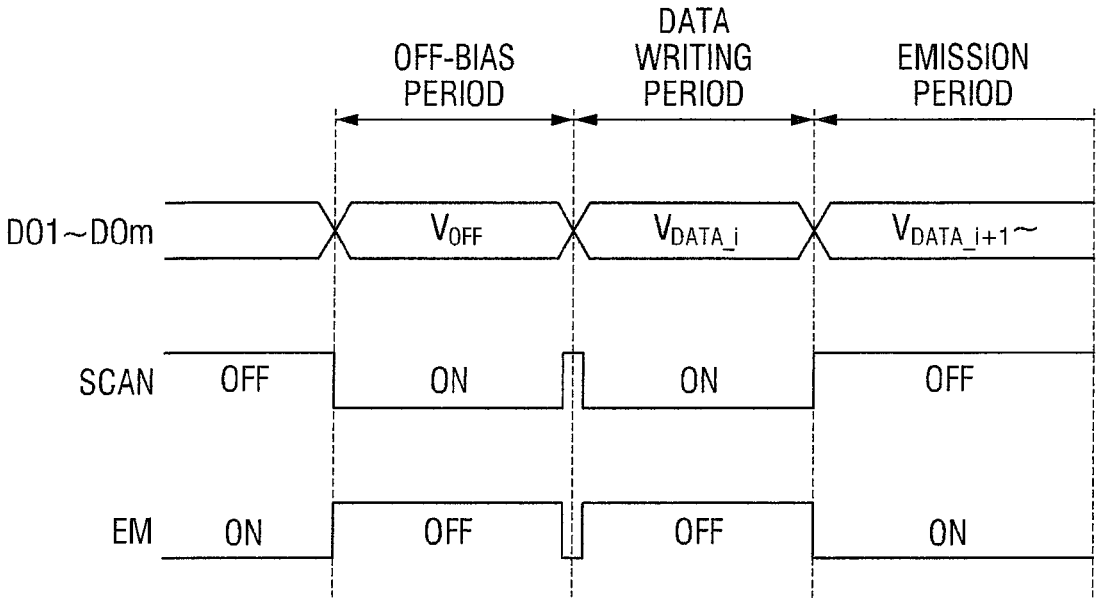
FIG. 9 is a timing diagram illustrating a display operation of the organic light-emitting display of FIG. 8.

FIG. 9 is a timing diagram illustrating a display operation of the organic light-emitting display of FIG. 8.

Referring to FIG. 8, the circuit diagram of the pixel of the display panel 100 of the organic light-emitting display according to the current embodiment is the same or substantially the same as the circuit diagram of the pixel of the display panel 100 of the organic light-emitting display according to the embodiment of FIG. 4 except that it does not include a sixth transistor T6 and a bias voltage terminal connected to the sixth transistor T6.

In the organic light-emitting display according to the embodiment of FIGS. 4 through 6, the bias voltage BIAS maintains a high level (e.g., a turn-off voltage) during the entire period of the low gray level sensing operation and the high gray level sensing operation to keep the sixth transistor T6 turned off. Therefore, a low gray level sensing operation and a high gray level sensing operation of the organic light-emitting display according to the embodiment of FIG. 8 may be the same or substantially the same as the low gray level sensing operation and the high gray level sensing operation illustrated in FIGS. 4 through 6, and thus repetitive drawings and descriptions thereof may be omitted.

Since the display panel 100 of the organic light-emitting display according to the current embodiment does not include the sixth transistor T6 switched by the bias voltage BIAS, the display operation of the organic light-emitting display according to the current embodiment may be different from that of the organic light-emitting display according to the embodiment of FIG. 7.

Referring to FIG. 9, during the display operation of the organic light-emitting display according to the current embodiment, a data switch SW_D may be turned on, and a sensing switch SW_S may be turned off. A third transistor T3 may be turned off by a sensing voltage SENSE applied as a high voltage (e.g., a turn-off voltage), and a voltage of a second power source ELVSS may be sufficiently lower than that of a first power source ELVDD.

The display operation of an $i^{th}$ scan line SLi illustrated in FIG. 9 may include an off-bias period, a data writing period, and an emission period.

In the off-bias period, a scan voltage SCAN of the $i^{th}$ scan line SLi may maintain a turn-on voltage, and an emission voltage EM may maintain a turn-off voltage. In addition, a data driver 400 may output an off voltage Voff that can turn off a first transistor T1 as data output signals DO1 through DOm.

That is, during the off-bias period, a second transistor T2 and a fifth transistor T5 may be turned on, a fourth transistor T4 may be turned off, and the first transistor T1 may be turned off.

In addition, a sustain voltage Vsus may be applied to a node connected to a source terminal of the first transistor T1.

In the data writing period, the scan voltage SCAN of the $i^{th}$ scan line SLi may be a low voltage (e.g., a turn-on voltage), and the emission voltage EM may be a high voltage (e.g., a turn-off voltage).

That is, in the data writing period, the second transistor T2 and the fifth transistor T5 may be turned on, and the fourth transistor T4 may be turned off. As described above, the third transistor T3 may remain turned off during the entire period of the display operation.

In the data writing period, the data driver 400 may output to a plurality of data lines DL1 through DLm the data output signals DO1 through DOm corresponding to data signals of pixels Pi1 through Pim connected to the $i^{th}$ scan line SLi, and a data voltage Vdata may be applied to a node G connected to a gate terminal of the first transistor T1 of each of the pixels Pi1 through Pim connected to the $i^{th}$ scan line SLi.

In addition, in the data writing period, since the fifth transistor T5 is turned on and the fourth transistor T4 is turned off, the sustain voltage Vsus may be applied to the node connected to the source terminal of the first transistor T1.

In addition, a storage capacitor $C_{STG}$ may be charged with a voltage corresponding to a difference between the data voltage Vdata and the sustain voltage Vsus.

Here, the data voltage Vdata applied to each of the pixels Pi1 through Pim may be determined using a memorized voltage $V_{MEM}$ stored in a memory 230 for each of the pixels Pi1 through Pim and a reference voltage Vref and may be given by Equation (6) described above:

$$V_{data} = V_{MEM1} - V_{ref}\left(\frac{\text{D_data}}{2^{n-1}}\right)^{\frac{\gamma}{2}}, \tag{6}$$

where n is a bit number determining the number of gray levels that a pixel can express, D_data is a gray level expressed by each pixel in image data, and y is a gamma correction constant of, e.g., 2.2. In addition, when a pixel has 256 gray levels, n=8 (8 bits), and D_data may have a value of 0 to 255 according to a gray level expressed by the pixel.

In the emission period, the scan voltage SCAN of the $i^{th}$ scan line SLi may be a high voltage (e.g., a turn-off voltage), and the emission voltage EM may be a low voltage (e.g., a turn-on voltage).

That is, in the emission period, the second transistor T2 and the fifth transistor T5 may be turned off, and the fourth transistor T4 may be turned on. As described above, the third transistor T3 may remain turned off during the entire period of the display operation. The first transistor T1 may be turned on according to the level of the data voltage Vdata applied thereto, thereby providing a driving current to an organic light-emitting diode.

In the emission period, since the fourth transistor T4 is turned on, the node connected to the source terminal of the first transistor T1 may be connected to the first power source ELVDD, and the voltage of the node connected to the source terminal of the first transistor T1 may be the same or substantially the same as the voltage of the first power source ELVDD. In addition, the node G connected to the gate terminal of the first transistor T1 may have a voltage level obtained by adding the voltage (ELVDD) applied to the node connected to the source terminal of the first transistor T1 to the voltage (Vdata-Vsus) charged in the storage capacitor $C_{STG}$ during the data writing period.

That is, the voltage of the node G connected to the gate terminal of the first transistor T1 may be given by Equation (7):

$$\begin{aligned} V_G &= V_{data} - V_{SUS} + ELVDD \\ &= \left[V_{SUS} - |V_{th}| - V_{ref}\left(\frac{\text{D_data}}{2^{n-1}}\right)^{\frac{\gamma}{2}}\right] - V_{SUS} + ELVDD \\ &= ELVDD - |V_{th}| - V_{ref}\left(\frac{\text{D_data}}{2^{n-1}}\right)^{\frac{\gamma}{2}}. \end{aligned} \tag{7}$$

In the emission period, the organic light-emitting diode may emit light in response to the driving current flowing through the first transistor T1, and the driving current flowing through the first transistor T1 when the organic light-emitting diode emits light may be given by Equation (8):

$$\begin{aligned} I_{emission} &= \frac{1}{2}\mu C_{ox}\frac{W}{L}(V_{SG} - |V_{th}|)^2 \\ &= \frac{1}{2}\mu C_{ox}\frac{W}{L}(V_{SG} - |V_{th}|)^2 \\ &= \frac{1}{2}\mu C_{ox}\frac{W}{L}\left(ELVDD - \left[ELVDD - |V_{th}| - \sqrt{\frac{2I_{ref}}{\mu C_{ox}\frac{W}{L}}}\left(\frac{\text{D_data}}{2^{n-1}}\right)^{\frac{\gamma}{2}}\right] - |V_{th}|\right)^2 \\ &= I_{ref}\left(\frac{\text{D_data}}{2^{n-1}}\right)^{\gamma}. \end{aligned} \tag{8}$$

Here, a reference current Iref may correspond to a driving current generated when the first transistors T1 of a plurality of pixels operate ideally without characteristic differences, for example, a driving current generated during light emission at a maximum gray level. Therefore, a driving current $I_{emission}$ of the first transistor T1 during light emission may generate a current irrelevant to other characteristic coefficients such as threshold voltage Vth and charge mobility. Accordingly, this may improve the luminance uniformity of the pixels of the display panel 100 of the organic light-emitting display device.

Embodiments of the present invention provide at least one of the following features.

A characteristic difference of each pixel, in particular, a characteristic difference of a driving transistor of each pixel may be compensated for using an external IC, thereby improving display quality.

In addition, a sensing error due to a leakage current may be removed in the compensation operation by the external IC.

However, the effects of the present invention are not limited to the one set forth herein. The above and other effects of the present invention will become more apparent to one of ordinary skill in the art to which the present invention pertains by referencing the claims, and their equivalents.

What is claimed is:

1. An organic light-emitting display comprising:

a display panel comprising a plurality of pixels respectively connected to a plurality of scan lines and a plurality of data lines;

a scan driver configured to sequentially transmit a plurality of scan signals to the scan lines;

a data driver configured to receive an image signal and to output a plurality of data output signals;

a voltage analog-to-digital converter (ADC) configured to receive analog sensing signals and to output digital sensing signals;

a data switch configured to connect the data lines to the data driver or to the voltage ADC in response to a switching signal; and a controller configured to receive original image data and the digital sensing signals, to process the original image data into the image signal based on the digital sensing signals and provide the image signal to the data driver, and to provide the switching signal to the data switch, wherein the data switch is configured to connect the data lines to the data driver, and the data driver is configured to apply an initialization voltage to the connected data lines, in a first initialization period, wherein one or more of the pixels are configured to charge one or more of the data lines with first voltages, the data switch is configured to connect the voltage ADC to the data lines, and the voltage ADC is configured to receive the first voltages from the connected data lines, to convert analog sensing signals corresponding to the first voltages into digital sensing signals, and to output the digital sensing signals to the controller, in a first sensing period following the first initialization period, wherein the data switch is configured to connect the data lines to the data driver, and the data driver is configured to apply the initialization voltage to the connected data lines, in a second initialization period following the first sensing period, and wherein the display is configured to change voltages applied to the data lines from the initialization voltage to second voltages, the data switch is configured to connect the voltage ADC to the data lines, and the voltage ADC is configured to receive the second voltages from the connected data lines, to convert analog sensing signals corresponding to the second voltages into digital sensing signals and to output the digital sensing signals to the controller, in a second sensing period following the second initialization period.

2. The organic light-emitting display of claim 1, wherein the first initialization period, the first sensing period, the second initialization period, and the second sensing period are included in a period of time during which an image of one frame is displayed.

3. The organic light-emitting display of claim 1, wherein the first sensing period and the second sensing period have the same lengths.

4. The organic light-emitting display of claim 1, wherein the controller is configured to identify voltages obtained by subtracting the second voltages from the first voltages based on the digital sensing signals corresponding to the first voltages and the digital sensing signals corresponding to the second voltages.

5. The organic light-emitting display of claim 1, wherein the data switch is configured to connect the data lines to the data driver, and the data driver is configured to apply the initialization voltage to the connected data lines, in a third initialization period, wherein one or more of the pixels are configured to charge one or more of the data lines with third voltages, the data switch is configured to connect the voltage ADC to the data lines, and the voltage ADC is configured to receive the third voltages from the connected data lines, to convert analog sensing signals corresponding to the third voltages into digital sensing signals and to output the digital sensing signals to the controller, in a third sensing period, wherein the data switch is configured to connect the data lines to the data driver, and the data driver is configured to apply the initialization voltage to the connected data lines, in a fourth initialization period, and wherein the display is configured to change the voltages applied to the data lines from the initialization voltage to fourth voltages, the data switch is configured to connect the voltage ADC to the data lines, and the voltage ADC is configured to receive the fourth voltages from the connected data lines, to convert analog sensing signals corresponding to the fourth voltages into digital sensing signals and to output the digital sensing signals to the controller, in a fourth sensing period.

6. The organic light-emitting display of claim 5, wherein the first initialization period, the first sensing period, the second initialization period, the second sensing period, the third initialization period, the third sensing period, the fourth initialization period, and the fourth sensing period are included in a period of time during which an image of one frame is displayed.

7. The organic light-emitting display of claim 5, wherein the first sensing period and the second sensing period have the same lengths, and the third sensing period and the fourth sensing period have the same lengths.

8. The organic light-emitting display of claim 5, wherein the controller is configured to identify voltages obtained by subtracting the second voltages from the first voltages based on the digital sensing signals corresponding to the first voltages and the digital sensing signals corresponding to the second voltages, to identify voltages obtained by subtracting the fourth voltages from the third voltages based on the digital sensing signals corresponding to the third voltages and the digital sensing signals corresponding to the fourth voltages, and to correct the image signal for each of the pixels based on the voltages obtained by subtracting the second voltages from the first voltages and the voltages obtained by subtracting the fourth voltages from the third voltages.

9. An organic light-emitting display comprising:

a display panel comprising a plurality of pixels respectively connected to a plurality of scan lines and a plurality of data lines;

a scan driver configured to sequentially transmit a plurality of scan signals to the scan lines;

a data driver configured to receive an image signal and to output a plurality of data output signals;

a voltage analog-to-digital converter (ADC) configured to receive analog sensing signals and to output digital sensing signals;

a data switch configured to connect the data lines to the data driver or to the voltage ADC in response to a switching signal; and a controller configured to receive original image data and the digital sensing signals, to process the original image data into the image signal based on the digital sensing signals and provide the image signal to the data driver, and to provide the switching signal to the data switch, wherein the data switch is configured to connect the data lines to the data driver, and the data driver is configured to apply an initialization voltage to the connected data lines, in a first initialization period, wherein one or more of the pixels are configured to charge one or more of the data lines with first voltages, the data switch is configured to connect the voltage ADC to the data lines, and the voltage ADC is configured to receive the first voltages from the connected data lines, to convert analog sensing signals corresponding to the first voltages into digital sensing signals, and to output the digital sensing signals to the controller, in a first sensing period, wherein the data switch is configured to connect the data lines to the data driver, and the data driver is configured to apply the initialization voltage to the connected data lines, in a second initialization period, and wherein the display is configured to change voltages applied to the data lines from the initialization voltage to second voltages, the data switch is configured to connect the voltage ADC to the data lines, and the voltage ADC is configured to receive the second voltages from the connected data lines, to convert analog sensing signals corresponding to the second voltages into digital sensing signals and to output the digital sensing signals to the controller, in a second sensing period, wherein at least one of the pixels comprises first, second, third, fourth, and fifth transistors that are p-channel metal oxide semiconductor (PMOS) transistors, a node connected to a source terminal of the first transistor is connected to a drain terminal of the fourth transistor, the source terminal of the first transistor is connected to a first power source by the fourth transistor, a node connected to a drain terminal of the first transistor is connected to an anode of an organic light-emitting diode, a cathode of the organic light-emitting diode is connected to a second power source, a drain terminal of a second transistor is connected to a node connected to a gate terminal of the first transistor, a source terminal of the second transistor is connected to at least one of the data lines, a gate terminal of the second transistor is connected to at least one of the scan lines, a source terminal of the third transistor is connected to the node connected to the drain terminal of the first transistor, a drain terminal of the third transistor is connected to at least one of the data lines, a sensing voltage is connected to a gate terminal of the third transistor, the drain terminal of the fourth transistor is connected to the node connected to the source terminal of the first transistor, a source terminal of the fourth transistor is connected to the first power source, a gate terminal of the fourth transistor is connected to an emission voltage, a source terminal of the fifth transistor is connected to a sustain voltage, a drain terminal of the fifth transistor is connected to the node connected to the source terminal of the first transistor, and a gate terminal of the fifth transistor is connected to at least one of the scan lines.

10. The organic light-emitting display of claim 9, wherein at least one of the pixels further comprises a sixth transistor, wherein a source terminal of the sixth transistor is connected to the node connected to the source terminal of the first transistor, a drain terminal of the sixth transistor is connected to the node connected to the gate terminal of the first transistor, and a gate terminal of the sixth transistor is connected to a bias voltage.

11. The organic light-emitting display of claim 9, wherein at least one of the pixels further comprises a storage capacitor connected between the node connected to the source terminal of the first transistor and the node connected to the gate terminal of the first transistor.

12. An organic light-emitting display comprising:

a display panel comprising a plurality of pixels respectively connected to a plurality of scan lines and a plurality of data lines;

a scan driver configured to sequentially transmit a plurality of scan signals to the scan lines;

a data driver configured to receive an image signal and to output a plurality of data output signals;

a voltage ADC configured to receive analog sensing signals and to output digital sensing signals;

a data switch configured to connect the data lines to the data driver or to the voltage ADC in response to a switching signal; and a controller configured to receive original image data and the digital sensing signals, to process the original image data into the image signal based on the digital sensing signals and provide the image signal to the data driver, and to provide the switching signal to the data switch, wherein at least one of the pixels comprises first, second, third, fourth, and fifth transistors, and wherein a node connected to a source terminal of the first transistor is connected to a drain terminal of the fourth transistor, the source terminal of the first transistor is connected to a first power source by the fourth transistor, a node connected to a drain terminal of the first transistor is connected to an anode of an organic light-emitting diode, a cathode of the organic light-emitting diode is connected to a second power source, a drain terminal of a second transistor is connected to a node connected to a gate terminal of the first transistor, a source terminal of the second transistor is connected to at least one of the data lines, a gate terminal of the second transistor is connected to at least one of the scan lines, a source terminal of the third transistor is connected to the node connected to the drain terminal of the first transistor, a drain terminal of the third transistor is connected to at least one of the data lines, a sensing voltage is connected to a gate terminal of the third transistor, the drain terminal of the fourth transistor is connected to the node connected to the source terminal of the first transistor, a source terminal of the fourth transistor is connected to the first power source, a gate terminal of the fourth transistor is connected to an emission voltage, a source terminal of the fifth transistor is connected to a sustain voltage, a drain terminal of the fifth transistor is connected to the node connected to the source terminal of the first transistor, and a gate terminal of the fifth transistor is connected to at least one of the scan lines.

13. The organic light-emitting display of claim 12, wherein at least one of the pixels further comprises a sixth transistor, wherein a source terminal of the sixth transistor is connected to the node connected to the source terminal of the first transistor, a drain terminal of the sixth transistor is connected to the node connected to the gate terminal of the first transistor, and a gate terminal of the sixth transistor is connected to a bias voltage.

14. The organic light-emitting display of claim 12, wherein at least one of the pixels further comprises a storage capacitor connected between the node connected to the source terminal of the first transistor and the node connected to the gate terminal of the first transistor.

15. The organic light-emitting display of claim 12, wherein the data switch is configured to connect the data lines to the data driver, and the data driver is configured to apply an initialization voltage to the connected data lines, in a first initialization period, wherein one or more of the pixels are configured to charge one or more of the data lines with first voltages, the data switch is configured to connect the voltage ADC to the data lines, and the voltage ADC is configured to receive the first voltages from the connected data lines, to convert analog sensing signals corresponding to the first voltages into digital sensing signals and to output the digital sensing signals to the controller, in a first sensing period, wherein the data switch is configured to connect the data lines to the data driver, and the data driver is configured to apply the initialization voltage to the connected data lines, in a second initialization period, and wherein the display is configured to change voltages applied to the data lines from the initialization voltage to second voltages, the data switch is configured to connect the voltage ADC to the data lines, and the voltage ADC is configured to receive the second voltages from the connected data lines, to convert analog sensing signals corresponding to the second voltages into digital sensing signals and to output the digital sensing signals to the controller, in a second sensing period.

16. The organic light-emitting display of claim 15, wherein the data switch is configured to connect the data lines to the data driver, and the data driver is configured to apply the initialization voltage to the connected data lines, in a third initialization period, wherein one or more of the pixels are configured to charge one or more of the data lines with third voltages, the data switch is configured to connect the voltage ADC to the data lines, and the voltage ADC is configured to receive the third voltages from the connected data lines, to convert the analog sensing signals corresponding to the third voltages into digital sensing signals and to output the digital sensing signals to the controller, in a third sensing period, wherein the data switch is configured to connect the data lines to the data driver, and the data driver is configured to apply the initialization voltage to the connected data lines, in a fourth initialization period, and wherein the display is configured to change voltages applied to the data lines from the initialization voltage to fourth voltages, the data switch is configured to connect the voltage ADC to the data lines, and the voltage ADC is configured to receive the fourth voltages from the connected data lines, to convert analog sensing signals corresponding to the fourth voltages into digital sensing signals and to output the digital sensing signals to the controller, in a fourth sensing period.

17. The organic light-emitting display of claim 16, wherein the first initialization period, the first sensing period, the second initialization period, the second sensing period, the third initialization period, the third sensing period, the fourth initialization period, and the fourth sensing period are included in a period of time during which an image of one frame is displayed.

18. The organic light-emitting display of claim 16, wherein the first sensing period and the second sensing period have the same lengths, and the third sensing period and the fourth sensing period have the same lengths.

19. The organic light-emitting display of claim 16, wherein the controller is configured to identify voltages obtained by subtracting the second voltages from the first voltages based on the digital sensing signals corresponding to the first voltages and the digital sensing signals corresponding to the second voltages, to identify voltages obtained by subtracting the fourth voltages from the third voltages based on the digital sensing signals corresponding to the third voltages and the digital sensing signals corresponding to the fourth voltages, and to correct the image signal for each of the pixels based on the voltages obtained by subtracting the second voltages from the first voltages and the voltages obtained by subtracting the fourth voltages from the third voltages.

* * * * *